US008016597B2

(12) United States Patent
Becker et al.

(10) Patent No.: US 8,016,597 B2
(45) Date of Patent: Sep. 13, 2011

(54) SYSTEM AND METHOD FOR INTERJECTING BILATERAL BRAIN ACTIVATION INTO ROUTINE ACTIVITY

(75) Inventors: Lee S Becker, Basking Ridge, NJ (US); Donald Joergens, Flemington, NJ (US); Vincent G Kiechlin, Colts Neck, NJ (US); Gregory G Keys, St. James, NY (US)

(73) Assignee: Brainon LLC, Basking Ridge, NJ (US)

( * ) Notice: Subject to any disclaimer, the term of this patent is extended or adjusted under 35 U.S.C. 154(b) by 893 days.

(21) Appl. No.: 11/065,299

(22) Filed: Feb. 25, 2005

(65) Prior Publication Data

US 2006/0191543 A1 Aug. 31, 2006

(51) Int. Cl.

| | |
|---|---|
| ***G09B 19/00*** | (2006.01) |
| ***A63B 69/00*** | (2006.01) |
| ***A61B 5/00*** | (2006.01) |

(52) U.S. Cl. ..... 434/258; 434/247; 600/300

(58) Field of Classification Search ..... 434/247, 434/258; 600/300

See application file for complete search history.

(56) References Cited

U.S. PATENT DOCUMENTS

| | | | | |
|---|---|---|---|---|
| 4,919,030 | A | 4/1990 | Perron | |
| 5,523,525 | A * | 6/1996 | Murakami et al. | 84/602 |
| 5,529,498 | A | 6/1996 | Cassily | |
| 5,743,744 | A | 4/1998 | Cassily | |
| 5,944,530 | A * | 8/1999 | Ho et al. | 434/236 |
| 6,388,181 | B2 * | 5/2002 | Moe | 84/477 R |
| 6,388,182 | B1 * | 5/2002 | Bermudez | 84/477 R |
| 6,719,690 | B1 | 4/2004 | Cassily | |

OTHER PUBLICATIONS

"Neurological & Motor Rehabilitation Overview," Interactive Metronome—Parents Neurological, Dec. 2, 2004 (http://www.interactivemetronome.com/im/par_neuro.asp).

"Visuospatial stimulus, Boston site," B.J. Casey, et al., http://hendrix.imm.dtu.dk/services/jerne/brede/WOEXP_360.html.

"Further Experiments," http://ruccs.rutgers.edu/~ccurie/subset9.html#illustration.

"Saccade-Related Activity in the Parietal Reach Region," The American Physiological Society, 0022-3077/00, Copyright 2000, pp. 1099-1102.

"COM—Cat OculoMotor Program," Dept. of Neurophysiology—COM Program Documentation, http://www.neurophys.wisc.edu/~jane/com/com.html.

(Continued)

*Primary Examiner* — Kathleen Mosser

*Assistant Examiner* — Jerry-Daryl Fletcher

(74) *Attorney, Agent, or Firm* — Davidson Berquist Jackson & Gowdey, LLP

(57) ABSTRACT

A method and apparatus are disclosed that automatically interject brain activations into video imaging activities or other activities of daily living. During a video game, for example, an interrupt causes a pause in the game and a commencement of an activity involving but not limited to bilateral portions of the body, the peripheral vision of the game-player, and a visual pursuit-type and saccadic-type action on the video screen. Alternatively, the brain activation can be merged into the content of the video game so as to be generally indistinguishable to the user. Automatic feedback from the system encourages more frequent brain activations when performance is determined to be diminished and less frequent brain activations when performance is determined to be enhanced. The combination of events in the activity is believed to engage the frontal lobes of the brain as well as other brain structures and stimulate brain health.

15 Claims, 18 Drawing Sheets

OTHER PUBLICATIONS

"Effects of Visual Training on Saccade Control in Dyslexia," Burkhart Fischer, Klaus Hartnegg, *Perception* 2000, vol. 29, No. 5, pp. 531-542 Feb. 2, 2000; http://www.perceptionweb.com/perabs/p29/p2666c.html.

"Training the ADHD Brain," Robert J. Davis, The Wall Street Journal, Jan. 18, 2005, D5.

Search Report and Written Opinion mailed Jun. 4, 2008 in PCT Appln. No. PCT/US2006/006606.

* cited by examiner

SYSTEM AND METHOD FOR INTERJECTING BILATERAL BRAIN ACTIVATION INTO ROUTINE ACTIVITY

FIELD OF THE INVENTION

This disclosure relates to software and/or hardware systems for interrupting computer activity or monotonous activity to encourage bilateral brain activation.

INTRODUCTION

During the past two centuries, scientists of various disciplines have studied the function of the human brain.

One of the most significant discoveries is that different sides of the brain have different characteristics and functions. For instance, it is known that the left frontal brain grows faster during development than the right frontal brain. However, the right posterior occipital portion of the brain tends to grow faster than the left during development. It is known that the posterior lobes of the brain are primarily used for sensing things, where the anterior part or frontal lobes are used for motor activities or moving our muscles. It was further discovered that motor representation is greatest on the left side of the brain, while sensory representation is greatest on the right side of the brain. This is supported by the fact that left brain-damaged individuals tend to develop disorders of movement, while right brain-damaged people tend to develop disorders of sensibility. Early on, it was viewed that the left brain hemisphere was the intelligent, educated and "human" side, while the right brain was the uneducated, animalistic side. With time, these views changed and researchers began to view asymmetrical brain function in a different way. For example, it was argued that the right brain played a predominant role in sensibility, emotion, and activities related to vegetative, instinctual life, which neatly complimented the intellectual human activities of the left brain. Therefore, although both sides of the brain have different functions, both sides work together to perform healthy human expression.

An example of this healthy human expression is associated with speaking. It is well documented that people who have an injury to the left frontal brain lose their ability to speak. However, people with damage to the right frontal brain can speak, they tend to lose the emotional tone of speech, resulting in a non-emotional or monotone voice. With respect to emotional states, it is known that people, who have an injury resulting in damage to the left-brain, tend to be apathetic, more or less silent and are generally passive individuals. In contrast, people with damage to the right brain tend to be emotionally volatile, suffer from manic-like symptoms and delusions of persecution. Finally, with respect to our regulation of our vital brain centers, whose job is to control homeostasis of the body, it is known that the right brain has the greatest influence over heart rate, while the left brain has the greatest influence over heart rhythm.

From the above examples, one can see that a brain, which is balanced in activity, is vital for normal human expression and the spectrum of human performance (the manner of reacting to stimuli).

There are many theories of how brain symmetry and asymmetry are maintained. In order to develop an understanding of this process, we must work at the normal workings and anatomy of brain structure and function.

When we study nerve cell function, we know that all nerve cells need three things. They are as follows:

(1) fuel
(2) oxygen
(3) activation

Fuel is provided by what we eat and drink, the ability of our digestive tract to absorb the nutrients from what we eat, and the integrity of our vascular system to deliver these nutrients to our cells.

Oxygen supply is dependent upon our ability to expand our chest to breathe, the quality of the air we breathe, the ability of our lungs to absorb the oxygen from the air into our blood stream, and finally the integrity of our vascular system, which will carry this oxygenated blood to our cells.

Activation of our nerve cells comes in many forms. There is stimulation from light, sound, taste, smell, touch, and the greatest being contraction or movement of our muscles. In fact, 95% of the stimulation to our brain comes from movement of muscle. When nerve cells are stimulated, changes inside the cell occur. One of the most important changes is the production of proto-oncogenes in the cell, which are used by the cell to make protein. Therefore, if a cell is not stimulated, it cannot produce protein and it cannot produce vital structures used for normal cell function. Protein is also used by the cell to grow connections to other cells. This is critical for normal nerve cell function because the job of a nerve cell is to convey information to other nerve and muscle cells. This concept of growing connections between cells is called plasticity. Plasticity of nerve cells is believed to be an evolutionary adaptation by the brain to meet the challenges of a changing environment.

Today, people are performing more daily activities, which stimulate our brains in an asymmetrical fashion. The result is an increase in plastic changes (connectivity) on one side of the brain and not the other.

Coordinated movement requires the normal operation of different brain structures. Different areas of the brain 'talk' to each other through various connections. In general, sensory information from the environment enters the back of the brain and is then transferred to the front of the brain to make sense of the incoming information. The front of the brain processes this information and then chooses which response will be appropriate. We would see this response as a behavior. A simple example of this would be if you wanted milk in your refrigerator. As you open the door and look inside, your eyes would send a message to the back of the brain telling it what is in there and where things are. This information would then be sent to the front of the brain for a decision to be made. That is, do I grab for the milk or the orange juice. What you take and the accuracy and smoothness with which your muscles carry out the activity would be the behavior. Therefore, if our brain has many choices as to how it will respond to a particular stimulus, which one it chooses is dependent upon the quality of the connectivity between the cells in the back of the brain (sensory portion) and its connectivity to the front of the brain (decision maker and responder), as well as the connectivity within itself. With this in mind, it is important to understand how brain structures are generally connected. For example, the back of the hemispheres are connected to the front of the hemispheres on the same side. Therefore, the right posterior brain has its greatest connections to the front of the right brain.

There is another important area of the brain associated with sensing things. This is the cerebellum. It develops in the back of the brain stem and is connected to the opposite side of the brain. Therefore, the right cerebellum is connected to the entire left hemisphere and vice versa. A major job of the cerebellum is to initiate voluntary movements, sense the movement which occurred, and make adjustments for the next movement. Problems between the connectivity of the cerebellum and the opposite brain hemisphere may result in certain abnormal behaviors. For example, people with decreased cerebellar functions have difficulties with judging the duration of an auditory stimulus and have difficulties judging the velocity of a moving stimulus. The cerebellum is essential for situations whereby we must learn temporal relationships between successive events. Not only is the cerebellum proposed to play a role in establishing the temporal patterns of muscular events, but it also plays a role in representing temporal information. Therefore, the cerebellum can be viewed as an internal timing system that not only regulates the timing of muscular events, but is also used whenever a precise representation of temporal information is required. This demand may arise in perception, learning, and cognitive processes. As such, the cerebellum will be implicated in these non-motor tasks, as well.

The inventors have recognized the function of the cerebellum and its relationship to the activation of other cortical areas. That is, before all volitional activities in the brain occur the cerebellum is activated first. Therefore, if the cerebellum is activated with temporal activities, there is a high probability that other areas of the opposite cortex for which it is highly connected, will be activated. Every time a nerve cell is activated, it produces protein that is used by the cell to grow more connections to other cells, as well as improving its own structural and genetic integrity. This increases efficiency of those pathways, thus improving performance. Therefore, activating the motor system in response to temporal as well as other specific types of stimuli would activate the brain in a more balanced fashion, promoting symmetry in brain activity.

The present inventors have observed that interrupting a person's normal daily activities (activities of daily living, which can be anything such as driving, watching TV, using a computer, playing video games, or anything else in which a hardware and/or software system can be employed to interrupt or supplement the activity) with a routine that encourages bilateral brain activation provides beneficial and therapeutic value to the user.

Even people who, for genetic, environmental or other voluntary or involuntary reasons, have tendencies to use and develop one side of the brain over the other can benefit by interruptions in their normal daily activities to engage in bilateral brain activation.

The inventors have also noticed that there are many conditions including genetic conditions, injuries, environmental conditions, and activities that they postulate are promoting asymmetrical brain usage. They have observed that certain clinical exercises are effective in patients that exhibit abnormal behaviors indicative of asymmetrical brain usage. One such set of activities is known among clinical psychologists by the commercial name Interactive Metronome and may involve a patient clapping in rhythm with an audio stimulation. The inventors are not aware of anyone using Interactive Metronome as a system for interrupting (overtly or discretely) daily activity to coordinate bilateral brain activation.

The Interactive Metronome website (www.interactivemetronome.com) identifies several patents associated with its system, namely U.S. Pat. Nos. 4,919,030 (to Perron); and 5,743,744; 5,529,498; and 6,719,690 (all to Cassily et al).

The entirety of the Perron patent is incorporated herein by reference and will be assumed to be of knowledge to the reader. In part, Perron describes a visual indicator of temporal accuracy of compared percussive transient signals. The device enables a musician, sound technician or sound engineer to determine whether a percussive transient signal is sounded in the correct moment in time. If a monitored musician plays a note before or after a reference note, a visual indicator, for example a set of LEDs, shows the musician the amount of time lapsed between the monitored note and the reference note (either early or late). Another visual indicator shows the musician that a sounded note matches the reference note, i.e., that the monitored note is substantially on beat with the reference note.

The entirety of the three Cassily et al patents are incorporated herein by reference and will be assumed to be of knowledge to the reader. In part, Cassily et al disclose systems that have application in therapy for injury to neuro-motor functions, in producing an enhanced sense of rhythm in users, in testing reflexes of individuals and in educational games. Specifically, Cassily et al describe producing a non-visual periodic reference signal, receiving a response from the user of the user's perception of an occurrence of the reference signal, and deriving a non-visual feedback signal as a function of the occurrence of the reference signal the user's response. The non-visual signals can be audio signals or response signals from a touch, clap, tap, impact, motion, pressure, proximity, sound, moisture or "any other parameter that may be manipulated by the user." The reference and the response signals combine to form a beat frequency that increases in frequency in proportion to the deviation of the response from the dead center position of the reference signal. As the user response gets closer to the reference signal, the beat signal will decrease in frequency. The result is a tendency of the technique to draw the user toward time alignment with the reference. Cassilly et al opine that the process contributes to enhanced neuro-motor functioning.

With respect to the "educational games" referenced in Cassily et al, two users are described who receive and respond to a reference signal and respective feedback signals. Each user is provided with a feedback signal that is a function of the time alignment of that user with respect to the reference signal. In that way, the system can be used as an educational or therapeutic "game."

After observing the beneficial effect of encouraging bilateral brain activation, the present inventors have realized that bilateral brain activation can be interjected into ordinary activities, either as interruptions, as requested occurrences, or as activities blended into a daily activity such as a video game or computer/television/media program, to promote healthy brain stimulation outside of the clinical environment. Each game interrupt test sequence will, eventually, with performance deficits and enhancements, include variations and additions of stimulation in order to promote symmetrical compensation and activation of and for the brain. In effect, each test becomes reinforced to not only measure deficit or improvement but also, each test becomes the stimulation to ensure stability at that level of performance or to drive enhanced performance.

Unless specifically recited in the appended claims, the present invention is not limited to a particular kind of bilateral brain stimulation and activation, although some example types are described below for purposes of illustration only. Nor is the invention necessarily limited to a particular kind of activity during which the stimulation can occur. In some embodiments the invention envisions game imaging interruption; in other embodiments the invention envisions interruptions during routine activity like driving or studying; while still other embodiments envision physical and cognitive activations. The context or environment in which the interruption or activity occurs can, but need not be, particular to the invention in its many forms.

In some of the embodiments, the invention can be described as a "pursuit event" or "saccadic event" rather than a timing event such as occurs in the Perron and Casilly patents. That is, the user's eyes are pursuing or saccading the occurrence of a contact event and timing their response to the pursued or saccadic occurrence.

BRIEF DESCRIPTION OF THE DRAWINGS

We now describe a preferred embodiment of the invention with reference in whole or part to the following drawings, in which.

DETAILED DESCRIPTION OF A PRESENTLY PREFERRED EMBODIMENT

Figure 1:
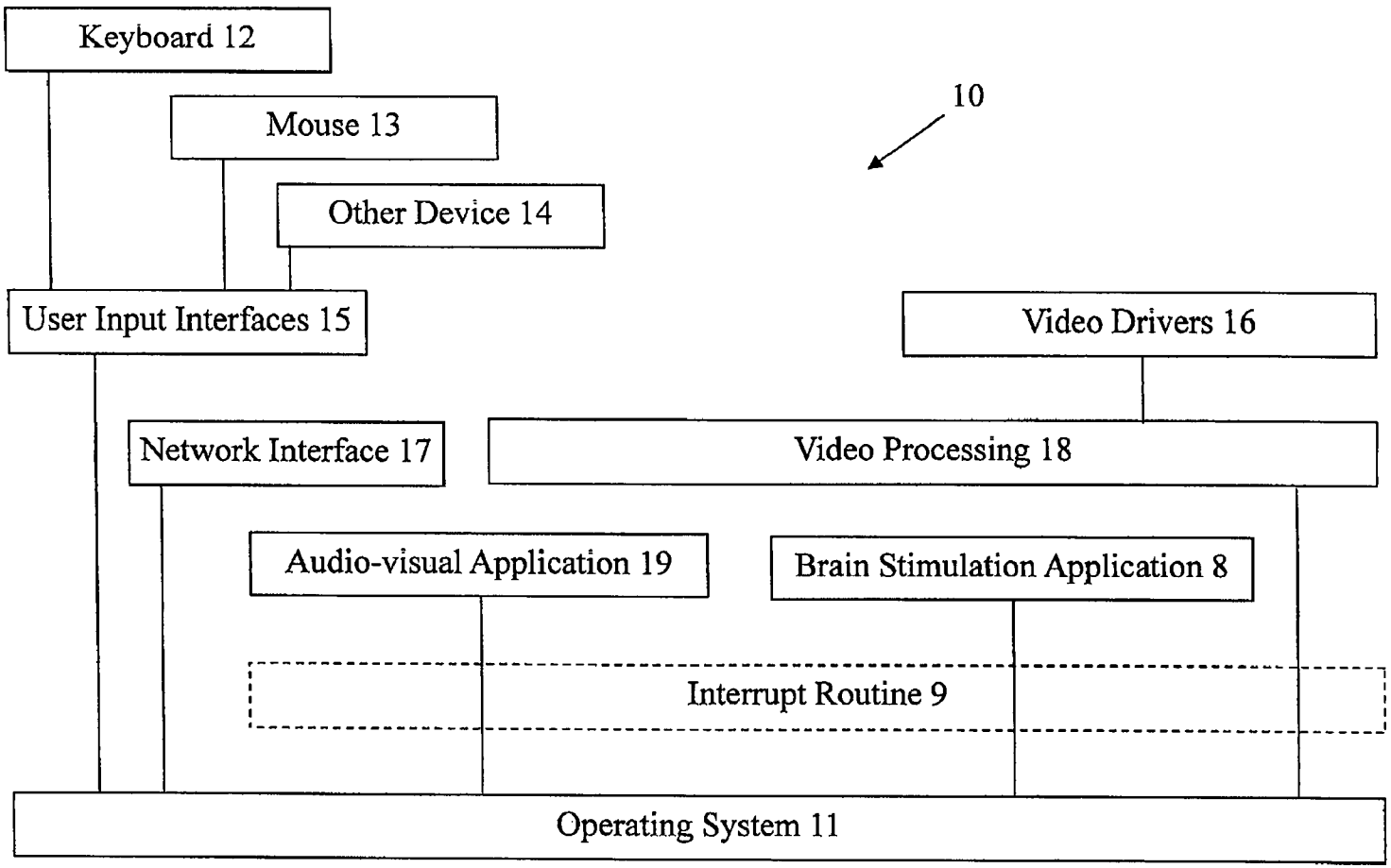
FIG. 1 is a schematic representation of an example system illustrating a brain stimulation application and interrupt routine.

The present concept is for a technology that specifically encourages beneficial activation of both sides of the brain. Activations that we have developed to promote such operation involve bilateral or unilateral operations from the user (such as but not limited to hand or finger use on a game controller, keyboard, telephone, etc.) coinciding with timed events generally (but not always) associated with the use of vision/visual pathway(s) activation, somatosensory pathway activation, auditory and cognitive pathways. The activities, for example, can be bilateral key presses on two different keys by each of the two hands of a keyboard user, or any other bilateral activity such as pressing built-in pressure switches on an automobile steering wheel coincident with an audible stimulation. The kind of bilateral activities and the timing event stimulation is not limiting. In addition, unilateral activities may also be called for to provide balanced brain activity as well. The inventors have discovered that the combination of specific unilateral or any bilateral activities coinciding with timed events during an interruption will produce excellent activation providing general beneficial brain activity enhancement.

Of course, the activities described above can be performed in a clinical environment or a home/work environment, but they also have additional value when they are interjected automatically into a person's daily routine or recreation. Thus, for example, the activities can be interjected in the middle of a video game, as will be described below. Alternatively, they may be interjected into an activity that occurs in a person's car or in a hang-on device attached to a person while jogging.

In a first example embodiment, of how the activities can be automatically interjected into a video image, such as commercially available video games, computer programs and television/cable/satellite images and/or broadcasts are supplemented (or an application is run in addition to such video image applications) to interrupt the video image and replace it with an on-screen game/program or an image with an enhancement program for a pre-determined time period in which certain interactive activities progress between the user/viewer and the virtual device.

In an alternative embodiment, this technology is written into the code of the interactive application and thus becomes an integral part of the application itself. This can be, in an example, a video game, such that the user of the video game perceives no discernable transition from the video game application and the brain activation. In such a case, the brain activation can be injected into the video game scenario such that the user's brain is activated and the system is recording baseline and feedback information while the user perceives a continuation of the video game environment.

This technology is the first technology that provides quality and objective indicia to the user (or a parent) that the user requires rest from a video game experience or can achieve increased performance in a video game/activity of daily living by brain activation (whether such activation are overt interrupts of the game or incorporations into the game). This technology provides performance enhancement and deficit management with active or passive direct attenuation moving toward a perfect (if unattainable) goal of brain symmetry with regards to function. Thus, technology now allows the user to participate in their brain rebalancing, to passively or actively provide beneficial enhancement of brain symmetry, and to define brain fatigue (basically when "enough is enough").

For example, presently a parent can identify when a child, who is swimming and playing in a pool, has had enough of that activity. There are physical indicia that indicate to the parent that fatigue is occurring and that the child may injure themselves if they continue. Because parents can not so easily ascertain brain function, with technology interaction (such as television watching, video game play, etc.), parents do not have such obvious indicia of when it is time to rest from the activity. The present system provides continual monitoring, testing, immediate brain activation, and feedback with specific interpolations that cause user/game beneficial interface—and let the parent or user know when detectible brain asymmetry indicates the value of a brain rest.

In an alternative example embodiment, this technology can be interjected into a scenario (such as a video game) with only passive user participation, i.e., without user interaction.

FIG. 1 shows an example system into which the interrupt routine has been incorporated. A standard computer operating system 11 is used to produce audiovisual events on the user's computer monitor and speakers by way of the audiovisual application 19. That application can be any application, such as but not limited to a standard, over-the-counter computer video game. The application 19 operates in conjunction with the operating system 11 in known fashion and will not be described herein. In FIG. 1, the interrupt routine 9 operates in conjunction with the operating system 11 to provide the interrupt functions described below. The interrupt routine may be a standard script function. After the interruption routine interrupts the audio-visual application 19, the brain stimulation application 8 commences. The brain stimulation application is another software routine that runs on the operating system 11 to create the visual images described, by way of example only, in FIGS. 2 and 3, receives the user inputs associated with those images, analyzes the user's responsiveness, and sets the timing for the next operation of the interrupt routine 9.

Both the audiovisual application 19 and the brain stimulation application 8 create video signals for display at the user's computer monitor via the video processing equipment (such as a standard computer video processor and associated circuitry incorporated into standard computers) and the video drives 16. Both applications (8 and 19) also may rely upon user input signals from a keyboard 12, mouse 13, or other computer input device 14. Those user input devices coordinate with the applications 8 and 19 via the user input interfaces 15. A network interface 17 may also provide access to the applications 8 and 19 for long-distance (network) connection to the benefits of the present technology.

In the preferred embodiment within the video imaging environment, a game interrupt, via the interrupt routine 9, stops the video game or video image/program being created/run by the audiovisual application 19, and switches to a specifically formatted event on the same screen. Based upon a given set of performance standards it forces the end user to rest the brain from his or her more intensive or constant viewing and interactive participation with a video image of any kind.

Figure 2:
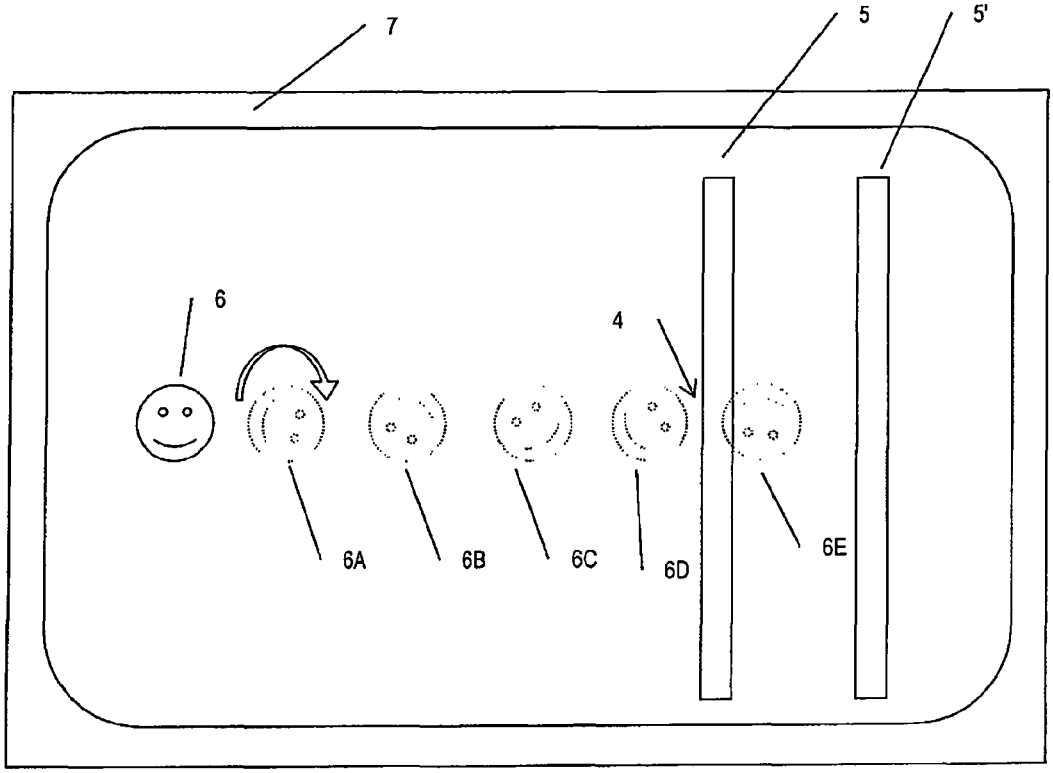
FIGS. 2 and 3 are graphical displays associated with an example brain stimulation application.
Figure 3:
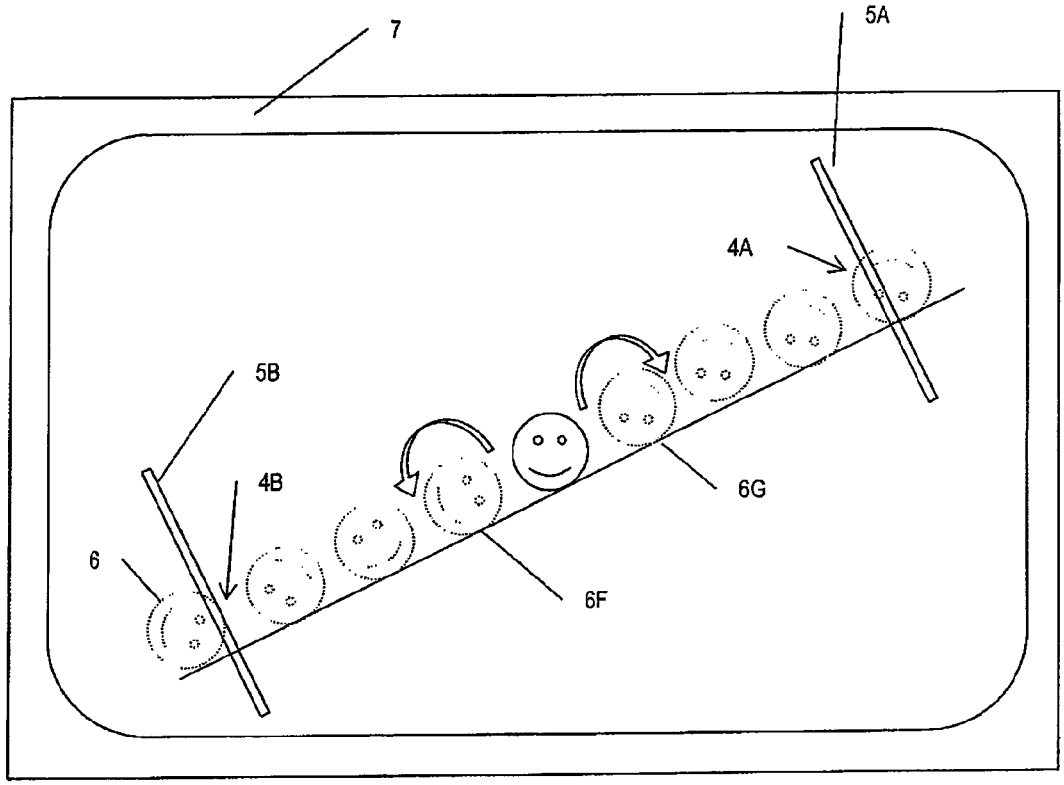

Secondly, the interruption in the video game/image is followed by activation of different portions of the participant's retinal fields via specific visual field stimulations as a direct resultant of performance comparisons from the interrupt program runs. In this example it would result from an activity that asks the participant to track one or more objects to predetermined contact points (called "walls") on the screen, from both eyes, as well as enforcing the need to "fix" gaze centrally in order to complete simple game-like tasks while bilaterally (with both hands, fingers, thumbs, or other bilateral appendages) depressing or activating, simultaneously, one or more buttons on a hand held controller (to include a touchpad, keypad, button, keyboard, peripheral, game controller, phone, television remote, dedicated device, or any other form of input mechanism or controller) at the point of contact of the first object connecting with a wall. Examples of such activity are shown in FIGS. 2 and 3. In FIG. 2, the interrupt routine has commenced to interrupt the audio visual application 19 and start the brain stimulation application 8. The brain stimulation application 8 creates video signals to graphically show an object 6 moving across a video monitor 7. As the object rolls to consecutive positions 6A, 6B, 6C, and 6D, the user prepares to press one or two keys on the keyboard 12 at the moment when the objects 6 reaches the graphically displayed wall 5 at about the point 4 on the monitor screen. When the object 6 reaches the wall 5 at point 4, the object continues rolling right through the wall 5 to position 6E and beyond. Thus, optionally, an additional wall 5' (or any number of additional walls beyond 5 and 5') can act as another location that calls for the user to press the keys when the ball reaches it/them. In such a multi-wall case, the user will be evaluated based on the ability to coordinate the bilateral activity with each timing occurrence between the ball and any of the walls.

The visual activity does not have to follow the above example to provide the bilateral brain activation. A variety of different kinds of activities, such as known clinical saccadic eye movements, can be used either in their known form as a video game interrupt or subtly incorporated into the active video game environment. In the latter case, for example, the action in the video game routine can be such that the actions, motions, or other events can induce saccadic eye movement, or other action/stimulus-response leading to desirable brain activations, without the user "realizing" that the video game content itself is providing beneficial brain activation and monitoring the user's performance (as related within the body of this document).

In addition to the above parameters, sound (both through frequency variations, beats, rhythm, etc.), and the timing or temporal effect of an object to wall, barrier or goal can additionally enhance brain activity. These sensory stimulations can individually or in any combination of two or more stimulations be used to promote symmetry compensation and activation of and for the brain.

The brain stimulation application 8 then records the user's responsiveness to the timed event. Namely, in the case of FIG. 2, the application 8 would record time characteristics associated with the times that the user presses the two keys and the time that the object 6 actually reached point 4 on the monitor screen (e.g., the timing between the first depression or device activation, the time differential between first depression/activation and wall contact, and/or the time delay or differential between simultaneous responses). That information is used at a later step 27 of FIG. 4, for example, to assess, quantify, or qualify user performance as well as the direction of specific types of interrupt patterns or trials.

Interrupts in the video game (either overt to the user, or subtle) act as user performance markers and, based on previous performance results, generate new sequences to affect better performance by stimulation of beneficial bilateral brain activation. In one example, a video game can embody a character moving across a screen as though in the complete context of the video game scenario; then, an other event, actor, or stimulus can cause either a saccade, pursuit, or fixation activation chosen in kind, time and duration consistent with feedback provided by the user's response to prior activation events. That is, the present interrupt allows one to truly remodel a brain and its function based on past performance to saccadic, pursuit or fixation events.

The inventors note that the present technology is different from the system described in the article by Davis, "*Training the ADHD Brain*," Wall Street Journal, Jan. 18, 2005, because in the article the clinicians were attempting to generate specific brain oscillatory patterns from a visual stimulation (i.e., alpha, beta and gamma waves.) The present technology, on the other hand activates the brain bilaterally, specifically the frontal lobes (but also other brain structures) which are known to be used for executive functions. The present system also measures neuroplasticity i.e., the brain's ability to make new connections by measuring performance changes in the user. The inventors contend that alpha, beta, and gamma brain waves are not associated with such activities, although some neuropsychologists seem to think that the ability to alter these brain wave patterns has positive benefit.

In FIG. 3, another example video screen embodiment is shown being prepared by the brain stimulation application 8 and presented on the monitor screen via the video processor 18 and video drivers 19. There, two objects 6F and 6G begin in the middle of the screen and roll outwardly in two different directions (perhaps 180 degrees to each other, but not necessarily). As in FIG. 2, the objects 6F and 6G roll toward walls 5A and 5B, respectively. When the objects reach points 4A and 4B, the user engages the bilateral (but could be unilateral) user response element, such as two keys of the keyboard.

The ball examples described above and noted in FIGS. 2 and 3 are simply illustrations to describe concepts of the inventions, and are not limiting. Other modifications to the activity types and the bilateral response types will be recognized by the artisan upon review of this complete disclosure and are to be incorporated within the full scope of the present invention.

Figure 9:
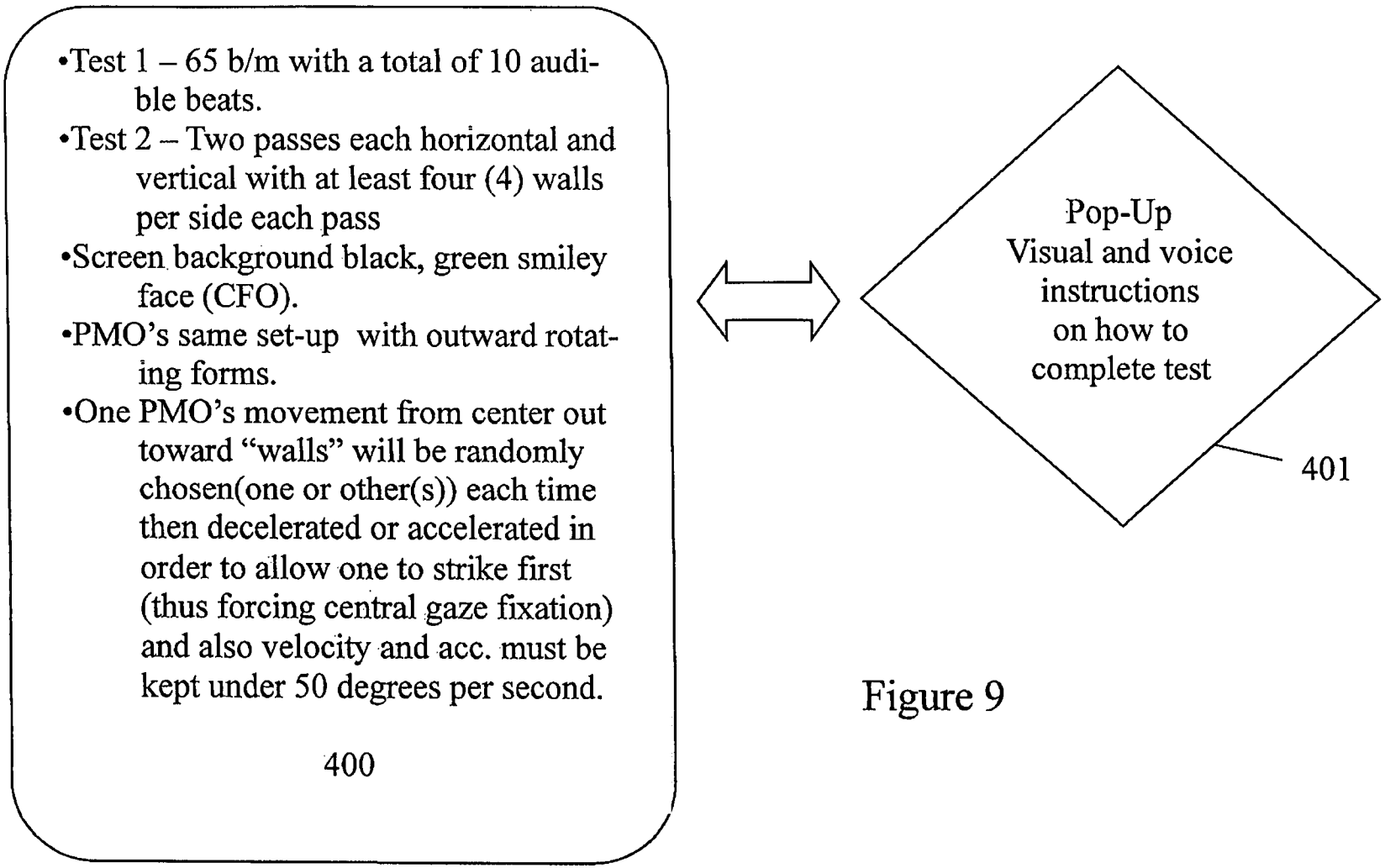
FIGS. 9 and 10 are flowcharts of various different example kinds of testing and interruption techniques.

In operation, the preferred embodiment in the video imaging environment adds the software applications that interrupt the normal video imaging application in order to provide the stimulations. As shown in FIG. 9, at first, the present software application will interrupt the visual apparatus with a pop-up window (whether it is video games, computers, television or any video image) to go through a set of instructions and activities to establish a baseline criteria for that individual's initial performance level. Two example baseline activities are shown in FIG. 9 as timing a user's bilateral response to an audible beat at a certain number of beats per minute (in the non-limiting example, the number is 63 beats/min though other rates can be used). In the second test, a user's bilateral response is measured in coordination with balls rolling past four walls, twice in the horizontal direction and twice in the vertical direction. The baseline testing is optional, but advantageously allows the software to measure a user's current performance relative to his/her own standard rather than a predetermined standard. The software application can update ability level automatically when it recognizes a pattern of minimum performance of a predetermined amount above the baseline test, such as 20% for example, above the baseline test. It will then establish this new standard as the baseline.

Figure 10:
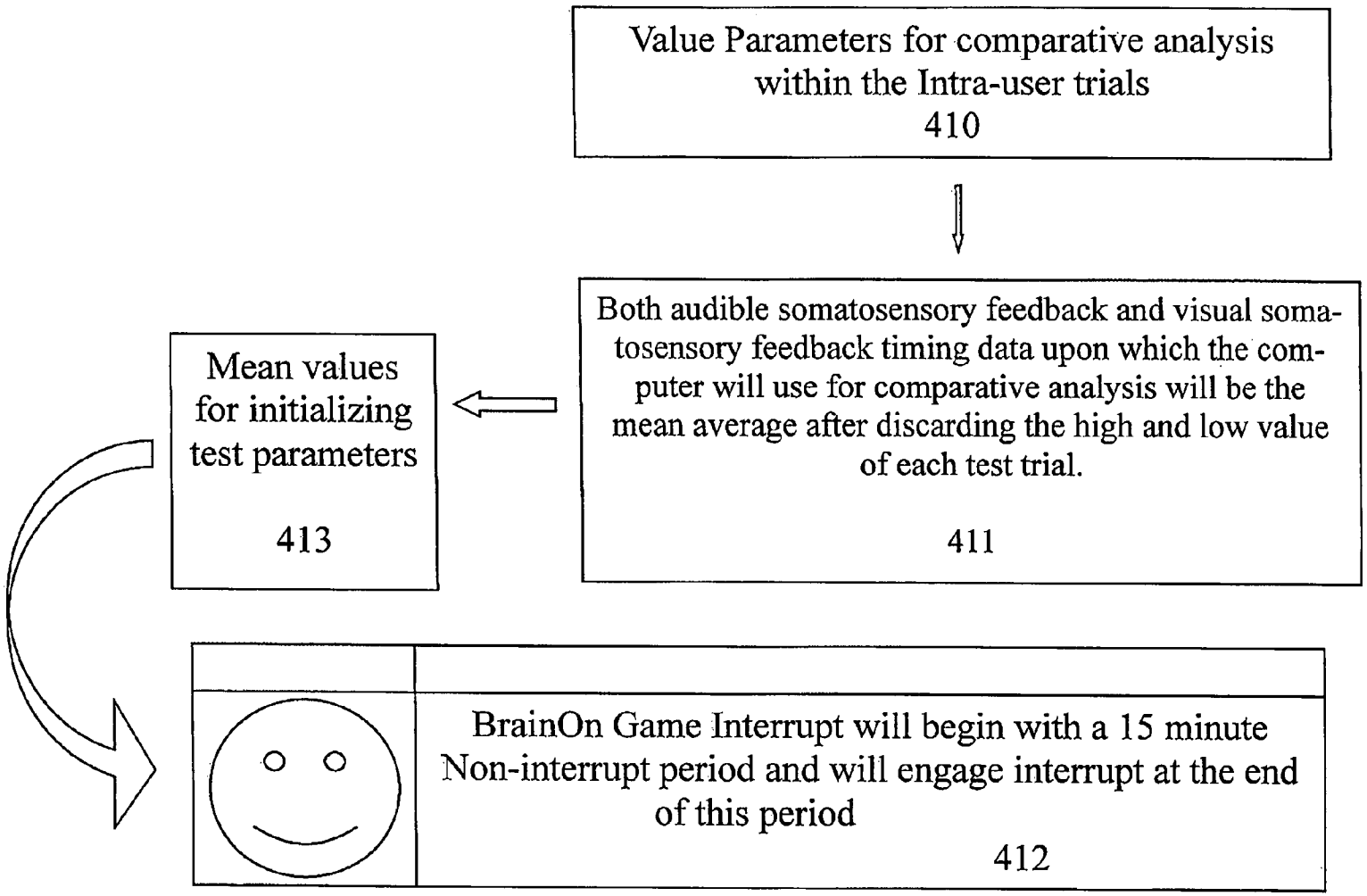

Once the baseline is established, the baseline is used in FIG. 10 as the value parameters for comparative analysis as future interrupts begin future runs. During a trial, various comparative criteria can be used to evaluate "acceptable" performance. One example method is shown in FIG. 10 as the averaging of a number of trial attempts (e.g., the deviation between each bilateral response and its corresponding visual occurrence) after discarding high and low values to avoid anomalous scores. The mean or other preferred statistical values may then be used both to evaluate current performance (to determine, for example, how much longer/shorter the next non-interrupt video game playing period will last) and as a new baseline (or modification to an existing baseline) for future run directions.

In an optional aspect, if the software application is being used in conjunction with a child's video game and for any reason the computer recognizes a diminishing bilateral activation performance over time, then the game can optionally shut down until a parent resumes game play through use of a specific parental control code. This will give the parent the ability to recognize that a child who was actually having improvement is now showing signs of a performance change. This enables a parent's control ability, in addition, so that a parent has the facility to enforce a short moratorium on game play, based upon an objective outcome of the child/users declining performance. While the brain is rested, the child may optionally be prompted to utilize indoor and/or outdoor play with games or equipment that can be specifically designed to help both the brain enhancement aspects of the invention and the player's later ability to perform in the video game after the rest period is over.

In another option, a player's performance levels are recorded for use in future play. In one such alternative, a log-in code correlates a user with his/her pre-recorded performance characteristics. Still further alternatives permit a portable memory card or stick to record a player's performance characteristics. In some such embodiments, the card or stick must be inserted into a port of a computer before a video game will be activated for that user, such that the video system can again provide the desired interrupts for bilateral brain activation in accordance with the user's pre-recorded performance characteristics. In that way, a child could play a video game at another person's computer also equipped with the present interrupt routine and still receive the same bilateral activation enhancements.

Although many embodiments described herein describe an "interrupt" associated with the brain activation routine, the "interrupt" need not be overt. In some embodiments, the brain stimulation activities can be embedded in, or built right into, the video game code so that the player obtains the beneficial aspects of the bilateral brain activation without overtly perceiving any "departure" from the video game.

In another option, a user may not be physically able to perform or desire to perform the interrupt activities, but may want to encourage bilateral brain activation. In this instance, the user may passively watch, listen, feel (somatosensory), or any combination of the activities being performed by the computer in order to encourage bilateral brain activation. The improved brain activity performance may be measured by (but not limited to) a passive device such as a blood pressure device, blood perfusion device, galvanic skin (responses device for sweat gland activity), heart rate, and heart rate variability, EEG, EMG, ECG, fMRI , PET scans, Infrared, Pupil finders etc.

In an overtly interrupting embodiment (as opposed to an embedded interruption), after the baseline analysis is completed and at a predetermined time, another pop-up window will appear giving the user auditory and written instructions for the auditory portion of the software application. Following these instructions an auditory queue will begin at, for example, 65 beats per minute. During the brain stimulation, the user performs a motor activity with both hands, either by simultaneously pressing 2 "joy stick buttons" or 2 keys at opposite ends of a keyboard in timing with the auditory queue. The computer will track the accuracy of the user's performance and will use it to gauge future interrupt activities. It may or may not be associated with visual stimuli described below (such as the logo in red ball, central screen as it pulses with the beat, or other activities described below) and other tasking requirements. The pop up window activity can run for approximately 10 seconds.

We note that certain times, frequencies, orders, and other characters of the activities are being described herein with some specificity (such as 65 beats per minute, 10 second durations, 20% baseline, etc.) but the present invention is not limited to any such specifics except as to those claims below that may specifically call out such specifics.

In the context of hand-held video game devices, additional activities can be added to the interrupt routine. For example, for hand-held devices that include a vibration feature, after the auditory portion of the activity described above, a somatosensory portion of the game interrupt will begin either in conjunction with or separate from a visual stimulation described below. In the somatosensory activity, the user performs a motor activity (for example, one or more button depressions) with both hands similar to the auditory portion, only in this instance the motor activity will be associated with vibration (somatosensory) of the hand held game at 65 vibrations per minute. Again, the computer can track the accuracy of the user's performance and will use it to gauge future interrupt activities.

Depending upon the individual performance parameters being exhibited by a user, the software can turn on/off different components of sensory stimulation (sequences) to create an enhanced beneficial brain activity effect.

In the same hand-held device environment, a visual activation portion of the game interrupt can begin. The inventors have discovered that this visual portion has significant value in encouraging bilateral brain activation in comparison to the earlier described activities.

In a specific, non-limiting example of this visual exercise, a colored screen (for example, green) will appear with a colored ball (for example red and approximately 2 inches in diameter for a 17 inch screen and similar ratio as screen size increases, although the ball to screen ratio can differ even within the same screen as ball sizes vary in order to create perceptual differences and thus different brain activations) in the center of the screen. The ball or balls may or may not contain differing subjects in order to maintain a visual perspective on the spin or rotation of the ball (the ball may contain a smiley face, a pinwheel, etc.) If the objects spin, then maintaining perspective on the spin of the peripheral balls is relevant to good execution of the activity. In this brain activation, the user performs a motor activity with both hands similar to the steps described above; only in this instance the motor activity will be associated with various visual activities. The following activation is simply an example and broader, more comprehensive embodiments are described elsewhere in this document. The invention should not be considered limited to the specifics of these examples.

Example Activity 1—Two (2) balls, of the same size as the center dot, bud off, split off, or calve off of the center ball, and move laterally from the center ball at speeds less than 50 degrees per second, rolling in the direction of their movement. For example, the ball moving to the right will roll clockwise and the ball moving to the left will roll counterclockwise. In this instance the motor activity will be performed by timing the peripheral ball reaching a barrier or "wall" on the furthest edges of the screen. The user will be instructed to "time" the intersection of the rolling balls with the wall by depressing two opposite buttons on the controller simultaneous with both balls contacting walls.

(1) Preferably, though not necessarily, a random one of the two balls will slightly accelerate toward its wall so that the user must attend centrally and observe both balls peripherally in order to gauge when the first ball strikes its wall. The acceleration may be random among the balls and may occur anywhere along a chosen ball's path as it moves toward its barrier. Of course, the same effect can be had by decelerating one or more randomly chosen balls as well.

(2) Optionally, the activity can use multiple walls. Imagine, as the peripheral balls track outward, upward or at 45-degree angles to horizontal they pass through a series of "walls" on their outward-bound trip to the furthest wall. As each wall is about to be contacted the user will have been instructed to perform a simultaneous depression of two opposite buttons on the controller, respectively controlled by a left and right hand. This would mimic a ball traveling in a straight line out from the bulls-eye of a dartboard or target. This would also allow for greater computations of performance in a smaller time window for the player/user.

(3) The computer can then track the user's accuracy in performance and use it to determine future interrupt ability levels and the length of uninterrupted game play prior to the next game interrupt sequence. For example a child who has timing frequencies within the 95% range will be allowed 10 minutes or more of uninterrupted play before another interrupt occurs. A child who for one reason or another is experiencing diminishing performance statistics will have less game play until his or her numbers come back up. A child who simply neglects the interruption activities or one who chooses to perform the activities with poor focus will inevitably have poor performance stats and may have their game interrupted very often, for example, every 60 seconds. This can then run for a number of trials, for example, one to three.

Example Activity 2—Preferable to Activity 1, in this Activity as the red balls move away from the center ball, one of the "peripheral" balls will accelerate or relatively decelerate at a different speed. The user will have to maintain focus on the center ball in order to predict which ball achieves the wall(s) first. The user will indicate this by depressing two opposing buttons on a controller device simultaneous to wall and ball strike. The computer will track the user's accuracy in performance and will use it for future interrupt activities as stated above. This activity can run for a certain predetermined duration, for example, approximately 5-15-30 seconds.

Example Activity 3—Similar to Activity 1 and Activity 2, this Activity may be performed with the balls moving vertically as well as at 45 degrees from the horizon.

In another set of example embodiments within the video game environment, the brain activation can be embodied in some basic components:

(1) The video background such as on a screen; and (2) The Central Fixating Object (CFO) and Peripheral Moving Objects (PMO).

The CFO and PMOs can have multiple representations depending upon the game video or lifestyle activity design and with relevance to the end users brain enhancement and brain activity promoting needs.

The CFO can take the form of a:

Ball

Star (classical)

Star (non-classical)

3-dimensional sphere

3-D star

Any of the above with sharply defined edges or/sharper background contrast

Any of the above with blurred outlines

Polygon with all above attributes

Any geometric shape in 2 or 3 dimensions

The edges of any CFO can pulse in sequence or out of phase with auditory beats or with user controller depressions or other connectable device that is volitionally engaged by user in any timing event.

The CFO's movement can be:

Without rotation but moving from a central position on screen out to the periphery within any of the 360 degrees of possible central to peripheral excursion.

With rotation/spin in either a clockwise or counterclockwise rotation and above directional vectors.

CFO can also move from peripheral point(s) to a central locus with all the above permutations as well. This will be called a Peripherally Fixating Object (PFO).

The CFO'S internal composition (IC) could include one or more of the following with each combination having different potential outcomes although each outcome would be for enhanced brain activity:

Color of CFO would be green as a baseline primary function.

The CFO could either function as a fixed color throughout a single screen pass (defined as a radial movement of one or both Peripherally Moving Objects (PMO's) out toward the periphery of both budded (mitoses) PMO's. or change colors.

The colors that could be fixed as well as transposing could range from red to violet.

The IC w/color could pulse or not.

Any variation of a kaleidoscope

Logos of company's, advertising, marketing, educational/learning material, etc.

Faces with the outer boarder of CFO intact or without any apparent border, rim or edge.

The amplitude or intensity of IC could vary as well with regards to physical dimensions, brightness, frequency, etc.

All the above statements describing the CFO's internal composition can be applied to the PMO and PFO as well.

The PMO and PFO can move at any acceleration or deceleration that the artisan so allows.

An embodiment can have a grid pattern, invisible to the user, which can have no overlay, a fixed overlay (i.e., a castle with many windows and doors) or a non-fixed action scene (i.e., as seen in video games, through the window of a moving automobile, movie, television show, etc.). Within this embodiment any of the PMO's, CFO's or PFO's can traverse through a video image or other image. While this object is tracked or pursued by the user, objects will appear within grid boxes at differing intervals. Depending upon the type of activity or appearance at the grid site the user will have to decide on a set of given actions. The action can be with the grid object or the traversing/moving object. For example, the grid can have an overlay of a medieval castle with 25 windows and doors. The moving object in this embodiment is overlaid by a dragon. The dragon is flying back and forth horizontally [in this embodiment] all the time searching for a knight or damsel to pop open a door or window. The user must keep attention fixed upon the dragon and depress certain bilateral buttons simultaneously if the dragon abruptly changes direction, color or any other permutation.

In this type of embodiment the activation routine can include synchronous image pulsing with sound (frequency can be altered) for passive stimulation of brain activation. As a window or door opens, the user would need to quickly switch attention to the identified grid box and depress the buttons if a knight appears but not if a maiden appears. If a knight appears and the timed event is within a certain time, for example, 0.5 seconds, the dragon would discharge a quick burst of fire and hit the knight. If the time was longer, then the knight would protect himself by closing the door/window. No action would be needed for the damsel. This is just one example embodiment that allows the use of saccade, pursuit and visual fixations as well as other visual mechanisms associated with specific eye movements in various directions in order to enhance performance by encouraging bilateral beneficial brain activation.

Meanwhile, the computer will track the user's accuracy in performance with grid site stimulation and will use it to set the parameters for future interrupt activities. This activity can run for a predetermined time, for example approximately 5-10-15-30 second intervals or more.

During the visual portions of the activities described above, the computer will link auditory and visual queuing within the parameters of the game interrupt. For example, as the PMOs moving laterally begin their movement, an auditory queue can begin. As the PMOs reach the lateral barrier, another sound can begin. The user will have to perform some bilateral action of paired parts of the body timed to an external sensory event (sound, light (vision), visual identification (vision+executive brain function), vibration, muscular contraction and sensory feedback, and all internal and external sensory, somatosensory, and cognitive stimulations).

A stimulation in one example to be described in detail below relates to balls (PMO, CFO, etc) moving simultaneously at the same speed. (An alternative embodiment has the balls moving at an accelerated speed.) The computer will track the user's accuracy in performance and will use it for future interrupt activities. This activity can run for a predetermined time, for example approximately 5-10-15-30 second intervals.

The game or other visual image application will resume for a predetermined amount of time based on user's accuracy in performance. The game can resume in a set period of time, for example, no longer then 60 seconds. This will of course, depend upon its end use as a video game, computer program, learning based system, athletic performance enhancement, clinical use, television image viewing, etc. Ideally, as game play and performance tests continue, the present routine will adjust play time and interrupt intervals/durations to achieve a "steady state" equilibrium between game play time and brain stimulation activity time.

Figure 4:
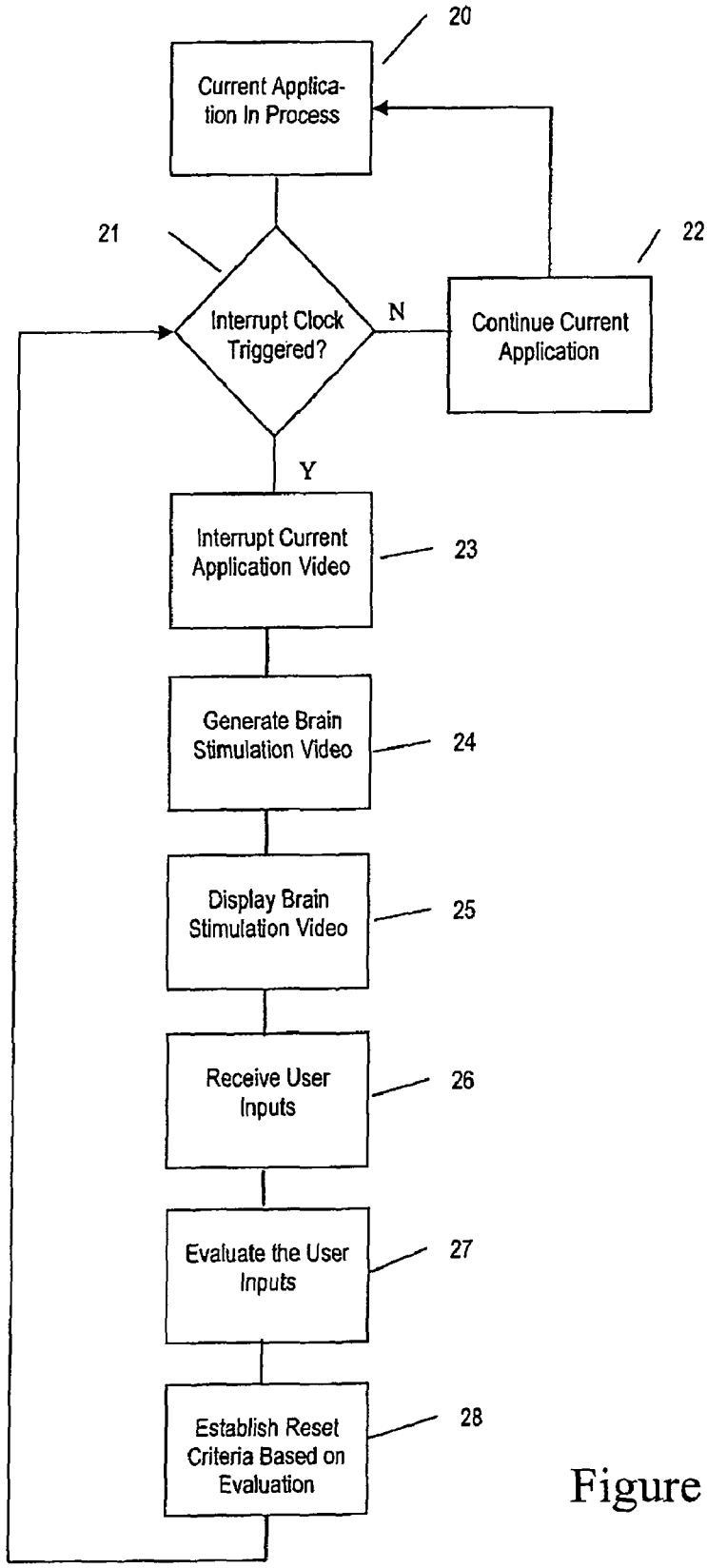
FIGS. 4-8, and 11-12 are flowcharts of various different example kinds of embodiments of brain stimulation applications and interrupt routines.

Example methods that further illustrate some concepts of the inventions are described in FIGS. 4-9. In FIG. 4, a current application is in progress at step 20 and is being commanded by the application 19 of FIG. 1. After a certain amount of application execution time (such as a predetermined number of minutes of computer game play), an interrupt clock times-out at step 21 in the interrupt routine 9. Until then, the current application (application 19) continues at step 22. When the interrupt time-out occurs at step 21, the interrupt routine pauses or interrupts the application 19 and executes the brain stimulation application 8 at step 23. The interrupt can occur by the interrupt routine 9 or may occur by command of the operating system 11. Upon the interrupt, the brain stimulation application 8 gets access to the video processing hardware 18 to produce video to the monitor at step 24. At step 25, the video is displayed, such as shown by way of illustration only, in FIG. 2.

When the video is displayed, the timed event (such as the rolling balls for example), begins. At some appropriate point, the user should execute the bilateral (but could be unilateral) response (on, for example, the keyboard or other input device) at step 26. At step 27, the brain stimulation application 8 evaluates whether the response was well timed, and or bilateral. The test can continue for multiple iterations upon which time, at step 28, the application 8 evaluates the total user responsiveness to determine how much time the interrupted application 19 can be resumed before the next interrupt. In other words, at step 28, the duration of the interrupt clock used at the next step 21 is established based on the quality of the user's response at step 26.

Figure 5:
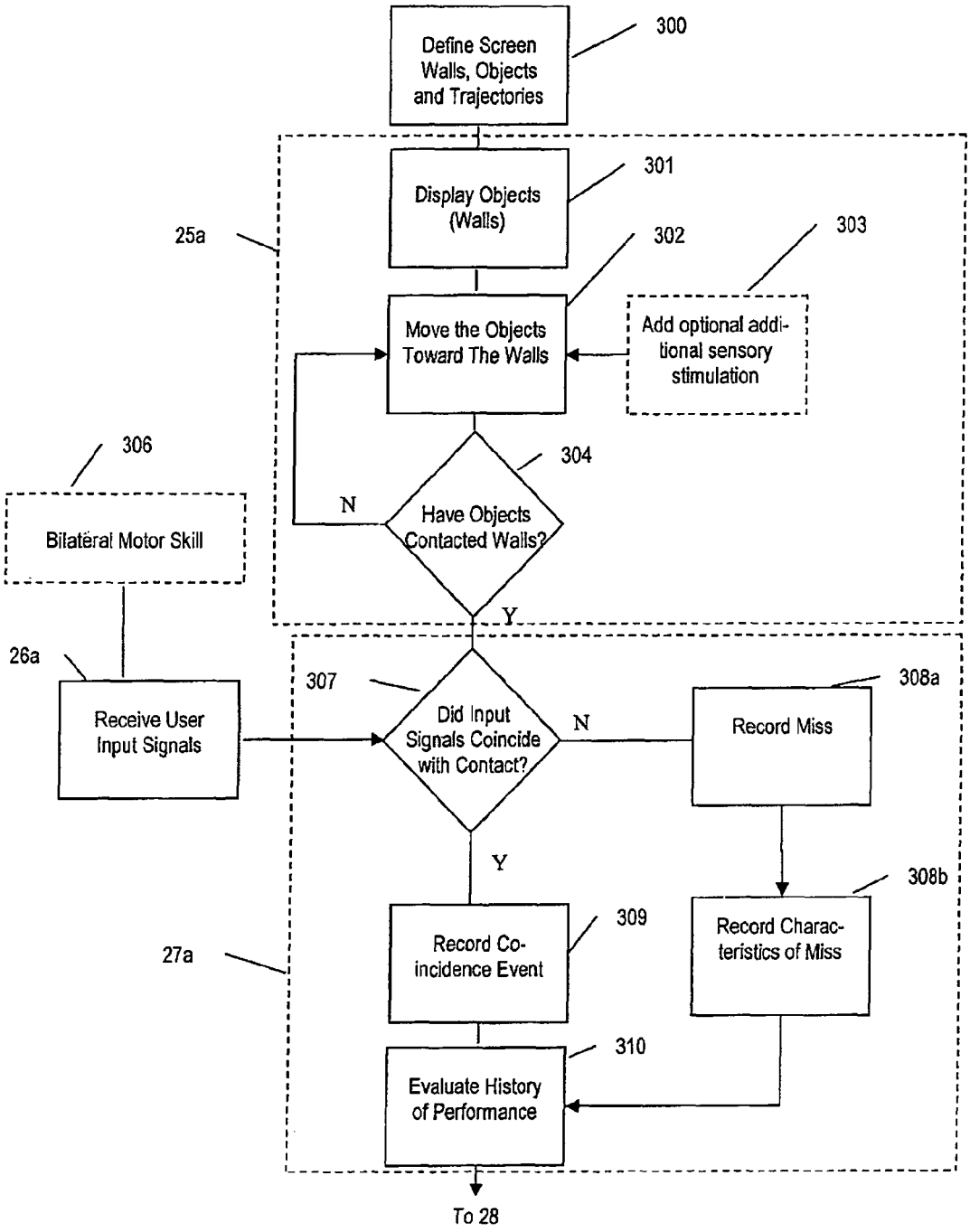

Some details of example steps 25 and 27 are shown in FIG. 5. With reference to the example of FIG. 3, walls, objects and trajectories of the objects are established at step 300 by the brain stimulation application 8 for display on the monitor at step 301 and movement in step 302. As the objects 6F and 6G move toward the walls 5A and 5B at step 302 (with or without other sensory stimulation at step 303), the application 8 awaits the bilateral input response 306 by the user at step 26*a*. At step 304, the application 8 determines whether the objects have reached the walls and if so, at step 307, whether the user signals coincided with the contact (or the time deviation there between). Alternatively, co-incidence may be measured to within a certain time difference such as the receipt of user keyboard signals within $1/10^{th}$ of a second (or any other number that is appropriate for the application) before or after the contact at step 304. If the user inputs occur outside of the set time, the miss is recorded at step 308*a* and the characteristics of the miss (for example, the extent of time deviation between the user input and the contact, or any other miss characteristics) are recorded at step 308*b*. If the user inputs occur outside of the set time, the then co-incidence event is recorded at step 309. In essence, steps 308*a/b* record "misses" and step 309 records "successes."

The performance test can then continue for a multiple number of iterations and perhaps a multiple number of different activities. At the conclusion, the history of performance is evaluated at step 310. Thus, if a user performs particularly well, the duration of the next current application session may be extended. If not, the duration may be shortened or delayed.

Figure 6:
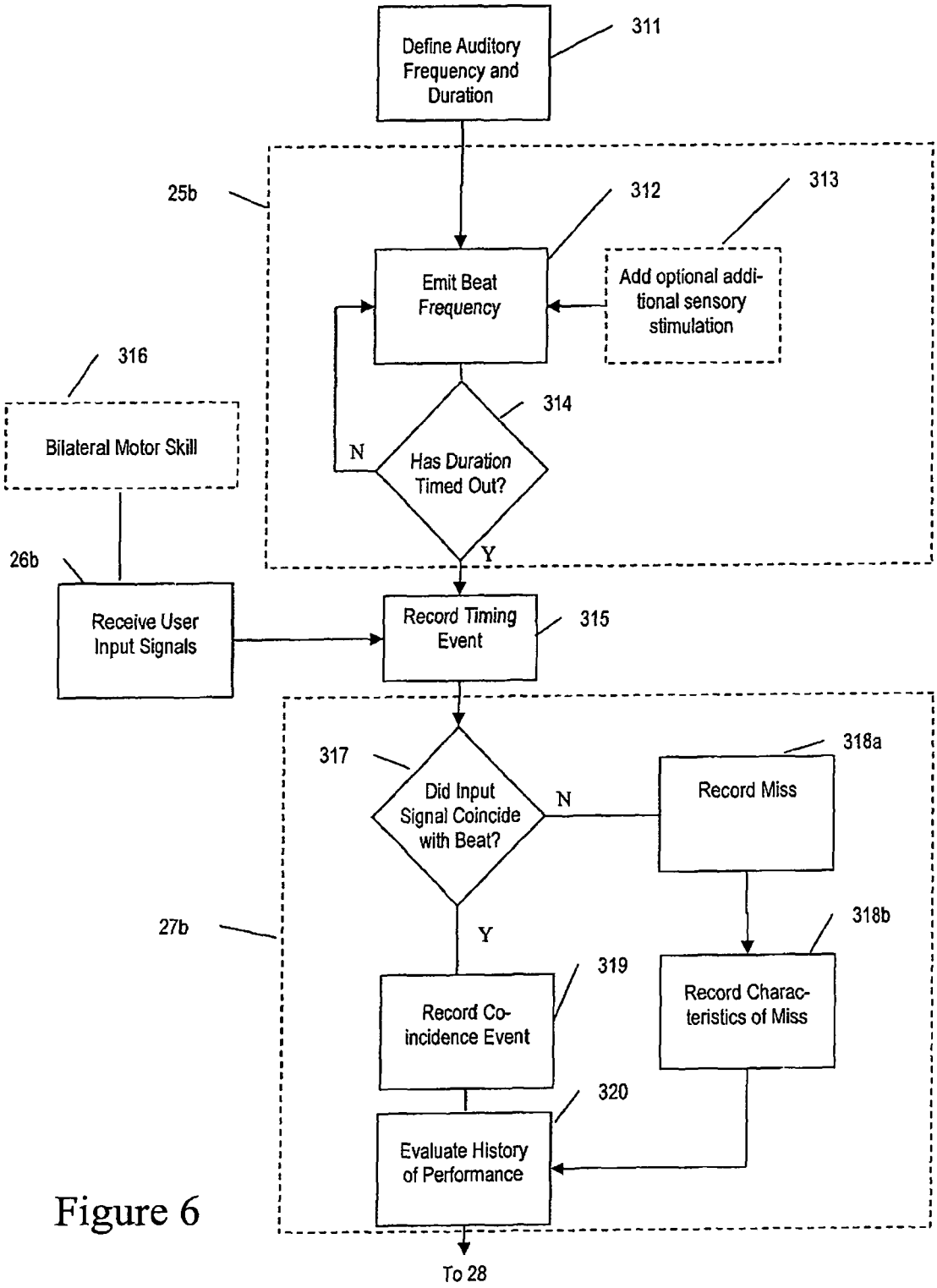

FIG. 6 illustrates another example activity in which steps 25 and 27 of FIG. 4 can be auditory-type activity rather than (or in addition to) visual one. Here, the auditory beat described earlier is set at step 311 and the user input signals

26*b* from a bilateral motor skill 316 are evaluated to determine coincidence therewith. Specifically, at step 312 the beat is emitted audibly, with or without other stimulation activities at step 313. The user's inputs to the beat are recorded until time-out occurs at step 314. Coincidence between the user's inputs at step 26*b* and the beat of step 312 are determined at step 317, with "misses" and characteristics thereof recorded at steps 318*a* and 318*b* and "successes" recorded at step 319. Historical evaluation then occurs at step 318*b*, just as in step 310 of FIG. 5.

Figure 7:
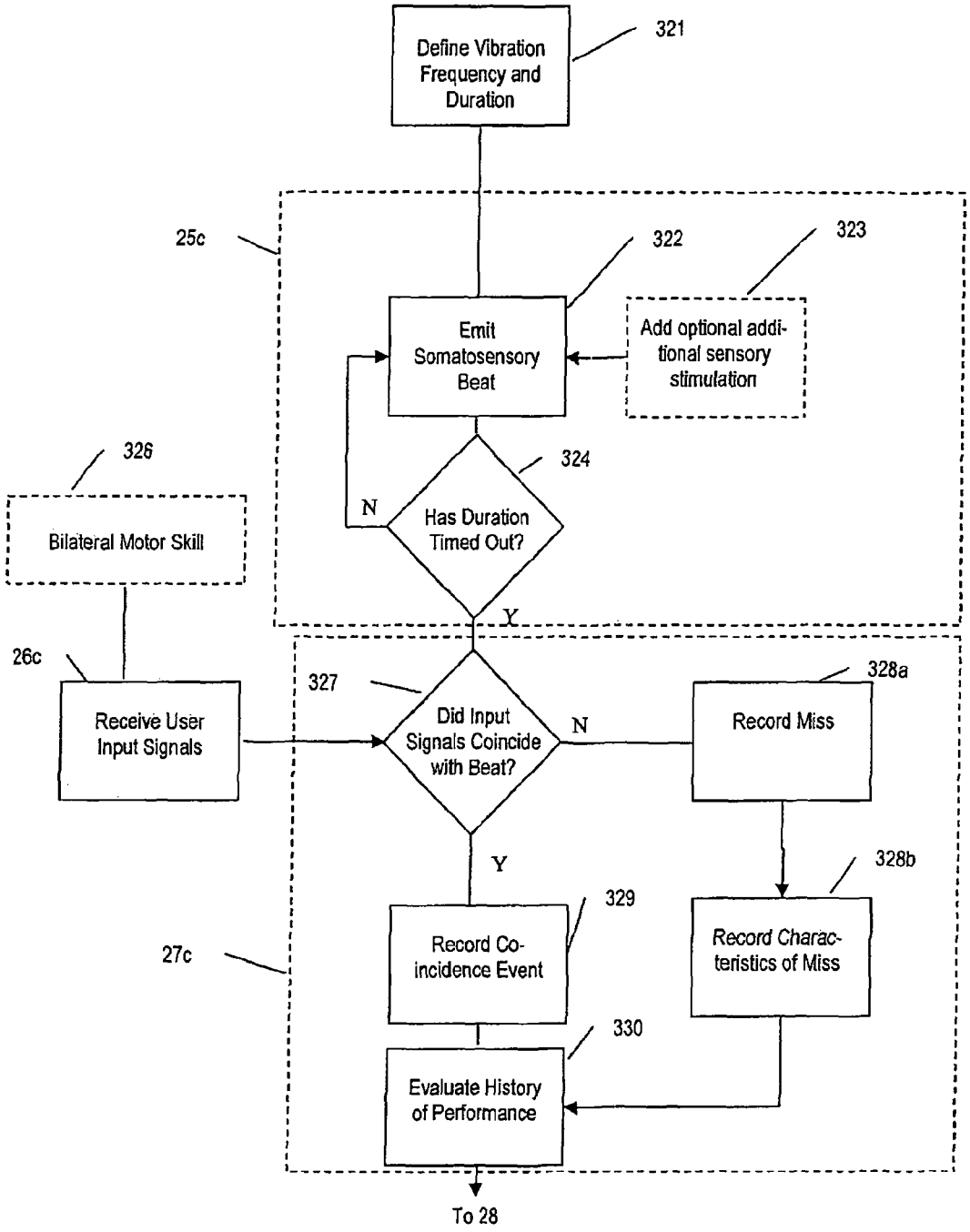

FIG. 7 is like FIG. 6, except that the activity described is from a vibration beat rather than an auditory beat. In FIG. 7 another example activity is described in which steps 25 and 27 of FIG. 4 can be vibration-type activities rather than (or in addition to) visual or audible ones. Here, the beat described earlier is set at step 321 and the user input signals 26*c* from a bilateral motor skill 326 are evaluated to determine coincidence therewith. Specifically, at step 322 the beat is emitted audibly, with or without other stimulation activities at step 323. The user's inputs to the beat are recorded until time-out occurs at step 324. Coincidence between the user's inputs at step 26*c* and the beat of step 322 are determined at step 327, with "misses" and characteristics thereof recorded at steps 328*a* and 328*b* and "successes" recorded at step 329. Historical evaluation then occurs at step 330, just as in step 310 of FIG. 5.

Figure 8:
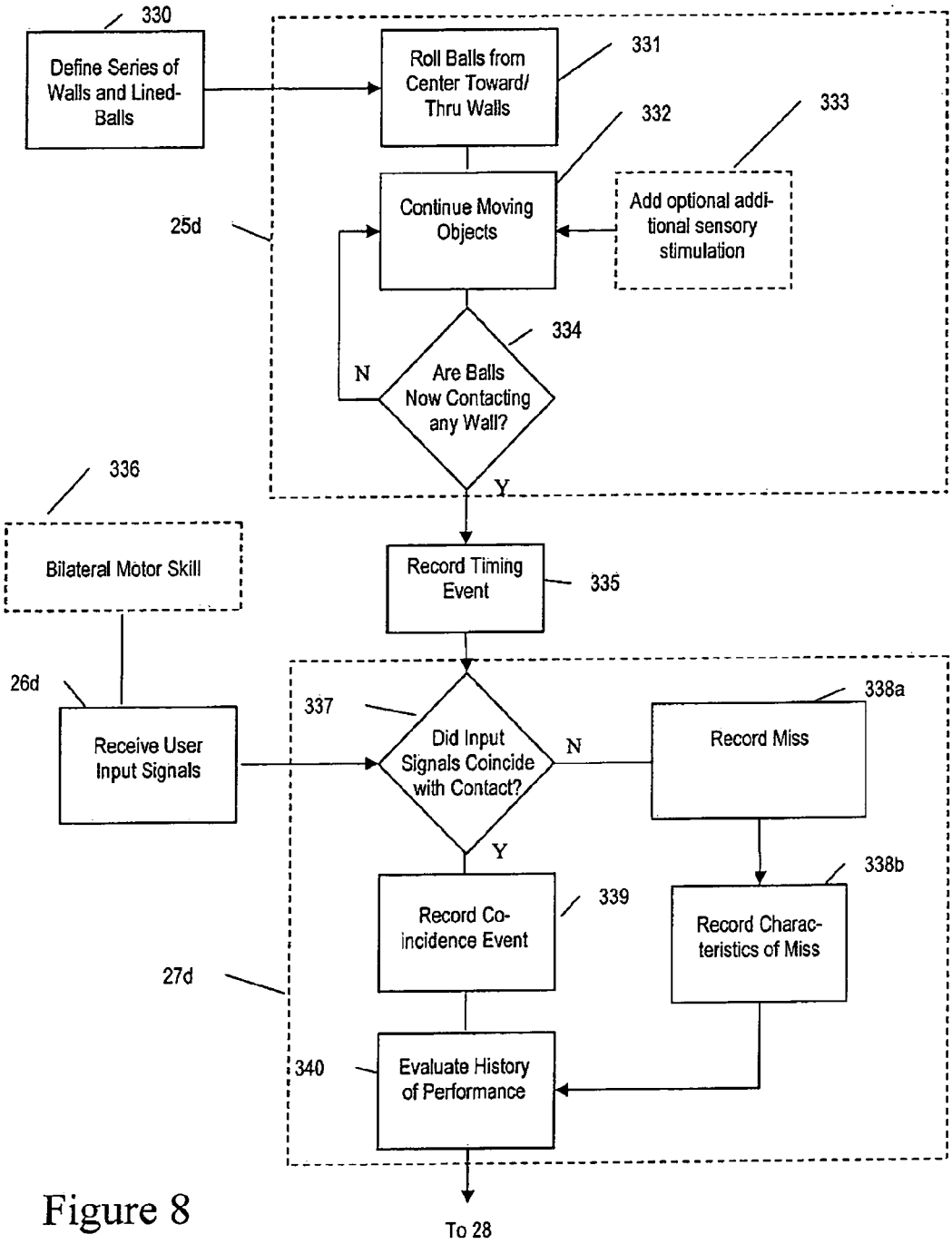

FIG. 8 illustrates another example in which multiple balls and walls are used, such as shown in FIG. 3. Here, the balls and walls are defined at step 330 and are then rolled on the monitor at step 331 toward and then through the walls. At step 332, the walls continue moving (with or without other sensory skills from step 333). When the balls contact the walls, the application 8 determines whether user input signals from a bilateral motor skill 336 are received at step 26*d*. The coincidence of the input signals with the ball contact events are recorded for perhaps multiple events at step 337. Again, misses and successes are recorded and evaluated at steps 338*a*, 338*b*, 339, and 340.

Figure 12:
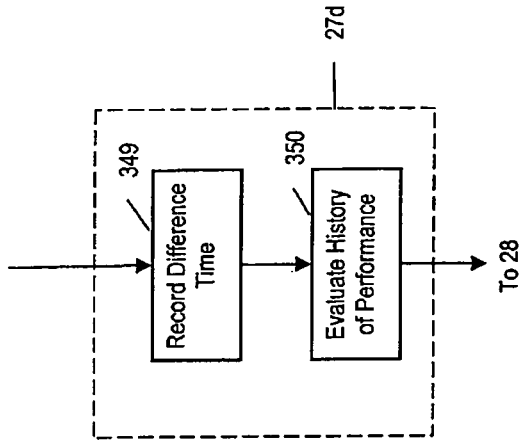

An alternative to blocks 27*a*, 27*b*, 27*c*, or 27*d* is shown in FIG. 12. There, the two differences between receipt of the input signals and occurrences of the pursuit events are recorded at step 349. An example of the history of such time difference is determinate step 350, such as by averaging the time difference data points, either in total or by dropping out one or more high/low data points.

The misses and successes can be evaluated (for example, at steps 310, 320, 330, and 340) in a variety of different manners and the precise way of doing so does not limit the present invention provided the evaluation generally rewards test results that show close matches between user inputs and sensory event occurrences. FIG. 9 illustrates an example process, including an example baseline test procedure that could provide initial definitions in steps 300 or 311. In FIG. 9, a pop-up window at step 400 interrupts the current application (or appears before the application commences user interaction) to provide instructions and initial testing. That test could be a 65 (or more or less) beat per minute audible test with a total of 10 audible beats for the user to bilaterally mimic, or two passes of PMOs with horizontal movement through four consecutive walls and then two passes of PMOs with vertical movement through four consecutive walls. Thereafter, as shown in step 401, the screen goes black and a green smiley face DFO appears. PMOs then rotate outward with one PMO randomly chosen to accelerate into a wall ahead of the other PMO(s). Example parameters of movement are shown in step 401.

FIG. 10 illustrates example brain stimulation activities (occurring after interruption of a video game, for example) in which value parameters from the test of FIG. 9 or from a history of earlier tests or trials are input to the system. The stimulation events occur and the results are averaged, those mean values are used to set the amount of time that the application will then be allowed to run before the next interruption occurs. The example of FIG. 10 shows at 410 that value parameters for comparative analysis within the intra-user trials can be directed, as shown at 411, where in the next step both audible somatosensory feedback and visual somatosensory feedback timing data, upon which the computer will use for comparative analysis, will be the mean average after discarding the high and low values of each test trial. The mean values for initializing test parameters, as shown at 413, can then be used in block 412 in which a BrainOn game interrupt will begin with a 15 minute non-interrupt period and will engage interrupt at the end of this period as shown at 412.

Figure 11:
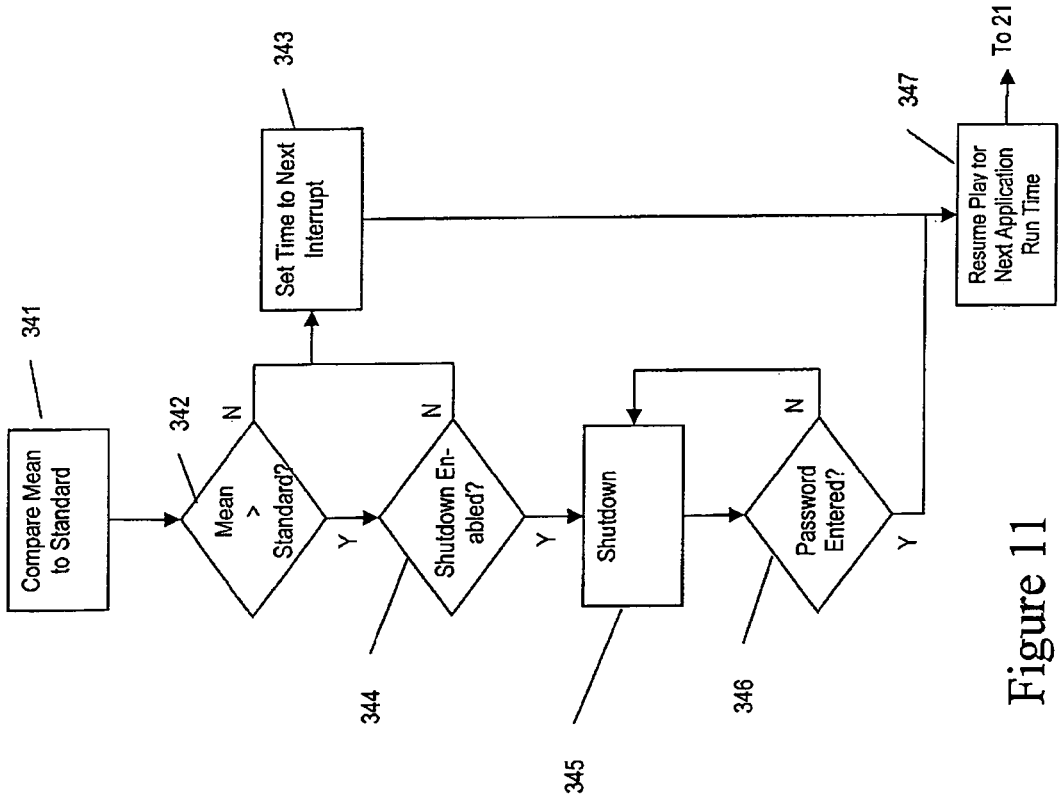

In FIG. 11, an example evaluation (that could be in, for example, steps 310, 320, 330, or 340) is further described. At step 341, the mean time deviation for a test period is calculated and the result compared to determine whether it exceeds a preset number of standard deviations. Alternatively, as historical data is collected over time, the application 8 can also evaluate whether (and how many) misses exceed a number of standard deviations at step 341. If the mean exceeds the standard at step 342 and shut-down mode is not enabled at step 344, then the next time to interrupt is set at step 343 based on the extent of difference between the mean and the standard deviation. A lesser next-play period can be set for longer differences and a greater next-play period can be set for smaller differences at step 343.

Optionally, a shutdown function can be enabled at step 344 where a parent, for example, requires a shutdown (rest) period after certain events, performance characteristics or time durations occur. If the shutdown function is enabled at step 344, then shutdown occurs at step 345 and the application only continues at step 347 after the password is entered at step 346.

The artisan will appreciate that the thresholds and standard deviations described herein need not be set permanent, but may be adjusted in accordance with the kind of application 19 being viewed or the kind of performance being recorded during a present test.

FIG. 12 illustrates an alternative embodiment to steps 27*d* (FIG. 8), though it can have application in any of the steps 27, 27*a*, 27*b*, or 27*c*. There, a time difference is recorded between each fixation event occurrence and each corresponding bilateral action, at step 349. Evaluation of the user's performance at step 350 is conducted based on the extent of the differences (which may or may not be statistically consolidated) between the fixation event occurrences and the corresponding bilateral responses. Thus, in the case of FIG. 3, where two balls are moving simultaneously toward sets of one or more walls, when one of the balls contacts the first of the walls (or both balls in the case of even velocity movement), the user's bilateral response is recorded as a time difference between the user input and the ball contact. The reset or next-to-interrupt period is then set at step 28 based on the user's performance on one or more of such tests.

Figure 13:
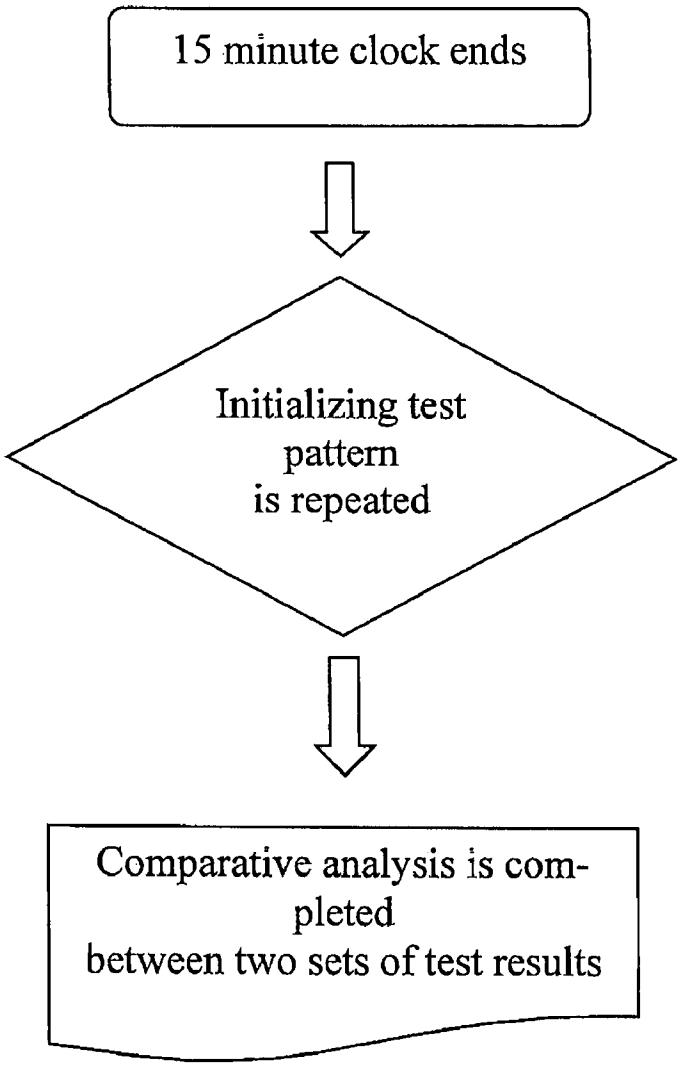
FIGS. 13-19 are flowcharts of example processes providing beneficial brain activation.
Figure 14:
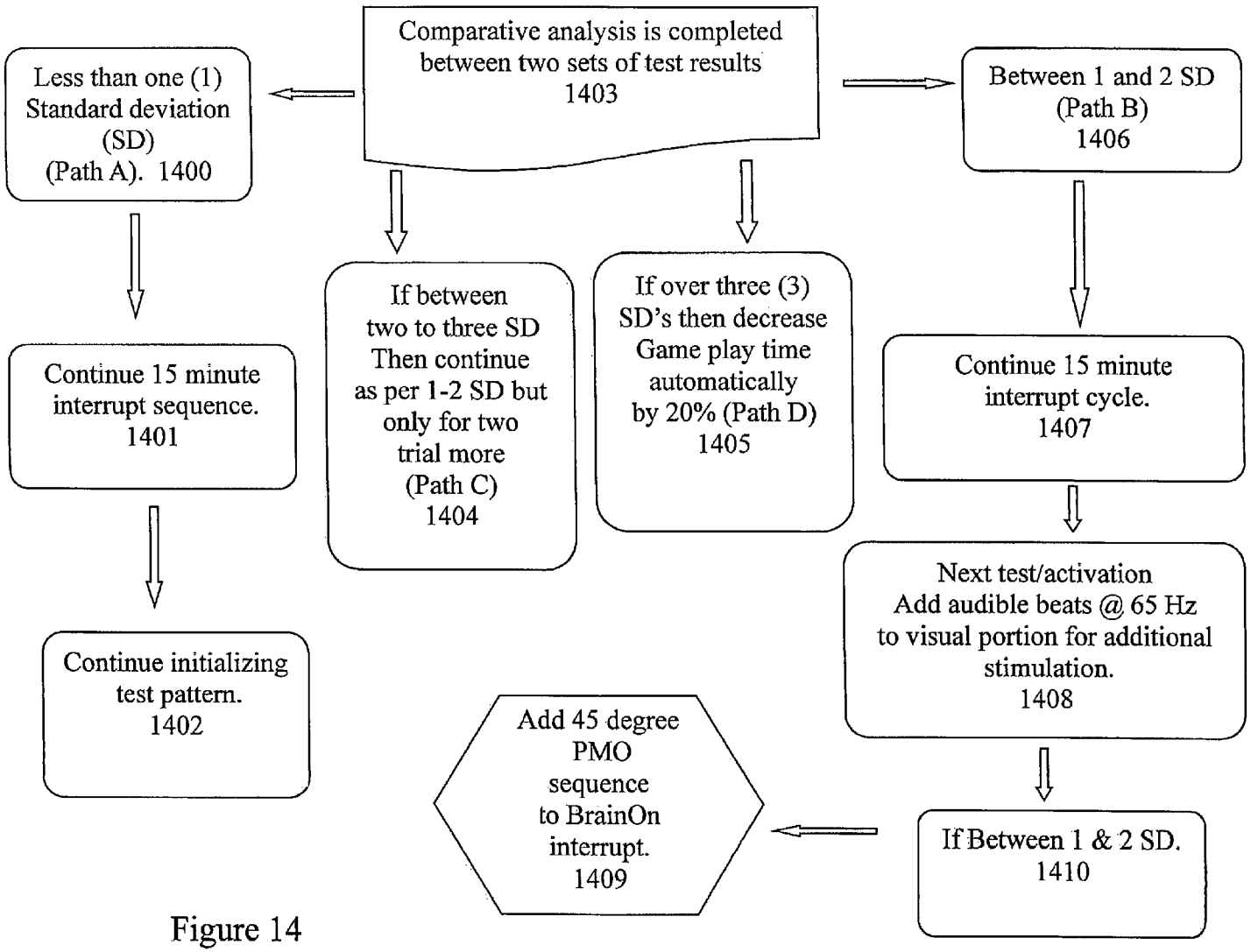

FIGS. 13-19 collectively illustrate an example algorithm for the brain activations. In FIG. 13, a game is played during which a fifteen-minute clock ends. Then, an initializing test pattern for saccadic, pursuit, or other activation is performed and the user's performance results recorded. A comparative analysis is completed between the current test results and an earlier test result in FIG. 13, carrying over to step 1403 of FIG. 14. If the current result is within a standard deviation at step 1400, then the process follows Path A through the remaining figures, including a standard 15 minute duration between interrupts of the game continued at step 1401, with a follow up test pattern at step 1402 (as in FIG. 13).

If the current result is within one and two standard deviations at step 1406, then the process follows Path B through the remaining figures including the standard 15 minute interrupt cycle at step 1407, followed by an additional audible stimulation in the next test at step 1408. Testing again occurs at step 1401 and if the results remain between one and two standard deviations, then a 45 degree PMO sequence is added to the interrupt at step 1409.

If the current result is within two and three standard deviations at step 1404, then the process follows Path C through the remaining figures. If the current result is greater than three standard deviations at step 1405, then the process follows Path D through the remaining figures.

Figure 15:
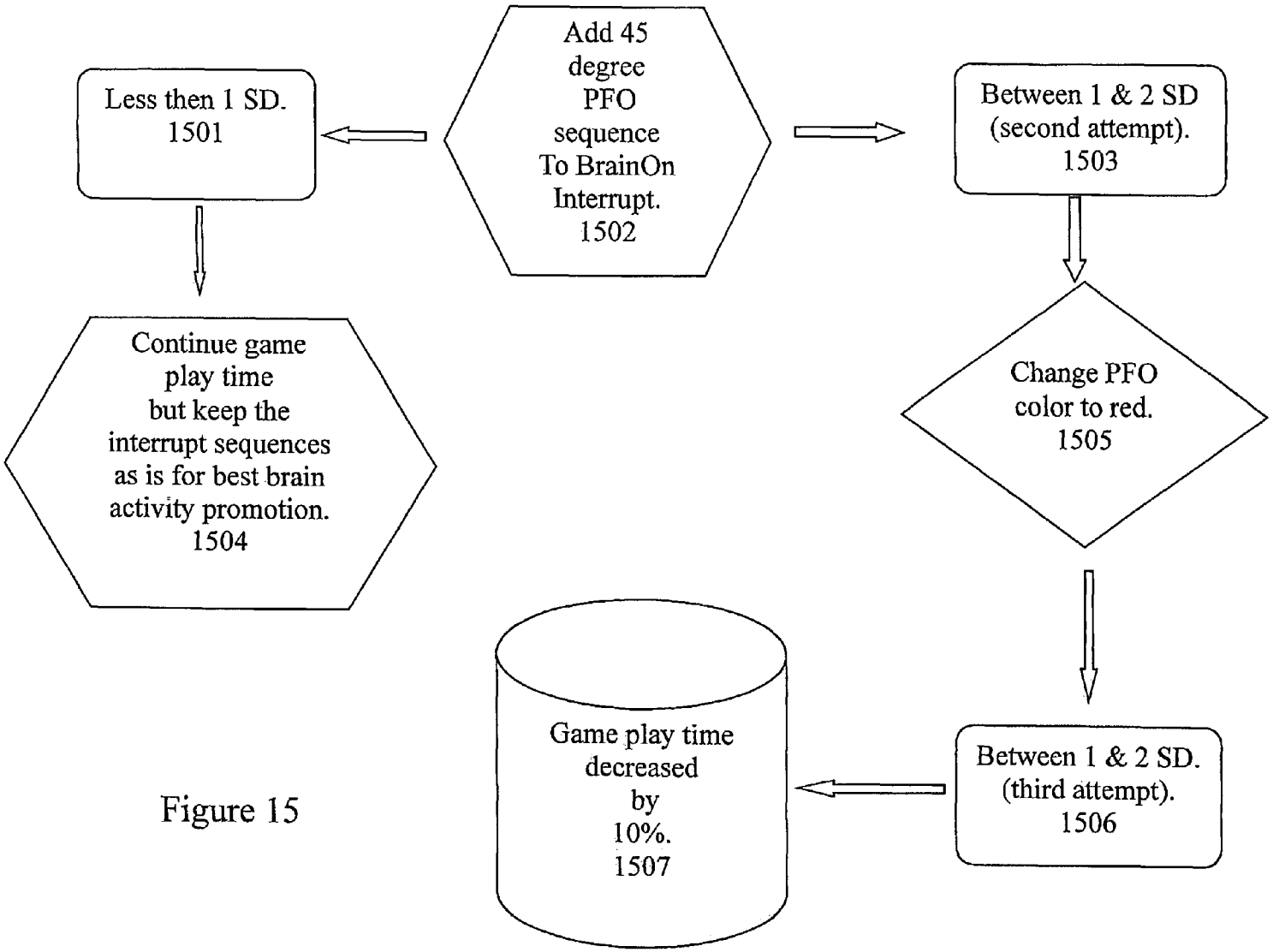

FIG. 15 illustrates an example process for testing at step 1502 an additional 45 degree PFO sequence. If after, the sequence, testing shows a result within one standard deviation at step 1501, game play continues at step 1504 with interrupt sequences at set intervals for best brain activity promotion as revealed in follow up occasional testing. If, however, the 45 degree PFO sequence reveals a result of between one and two standard deviations, then the PFO color is changed at step 1505 and a third testing attempt of the 45 degree PFO is administered. If the result is still between one and two standard deviations at step 1506, then game play automatically decreases between interruptions by (but not limited to) 10% at step 1507.

Figure 16:
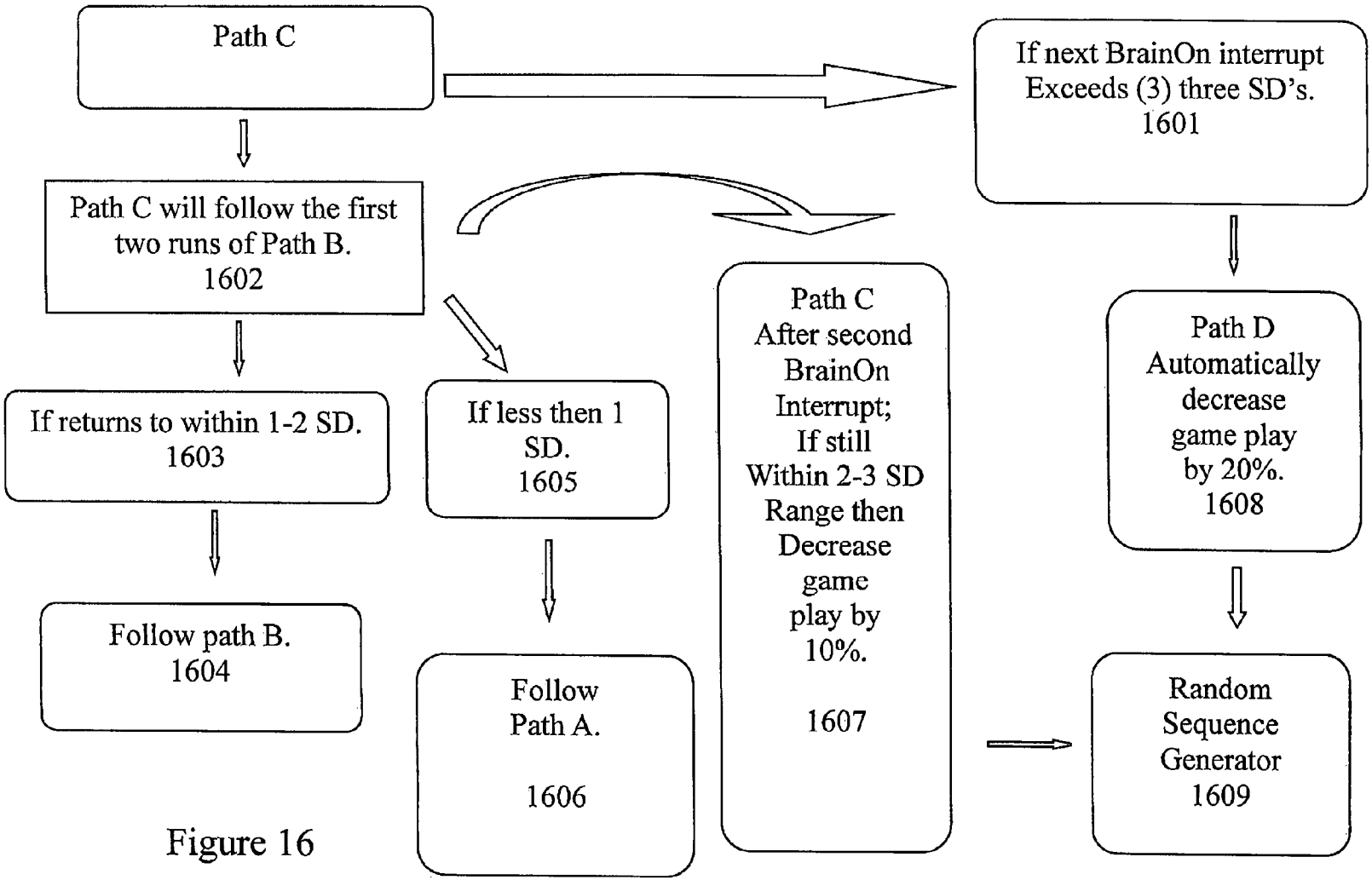

As previously described, Path C is followed when initial testing reveals a result between two and three standard deviations. FIG. 16 illustrates more of that path. At step 1602, Path C follows the same two runs of Path B (steps 1407-9 (and perhaps 1502-7 depending upon the embodiment employed)). If the user returns to a performance level between one and two standard deviations, at step 1603, the process moves to Path B at step 1604. If the user's performance dramatically improves to within one standard deviation at step 1605, then Path A is followed at step 1606. If the performance level, however, remains in the two to three standard deviation range at step 1607, game time is decreased by 10% and the process moves to the random sequence generator of step 1609 (correlated to step 1701 in FIG. 17). If the performance level falls to greater than three standard deviations, then the process go to Path D, game time is decreased (but not limited to) 20% and the process goes to the random sequence generator at step 1609/1701.

Figure 17:
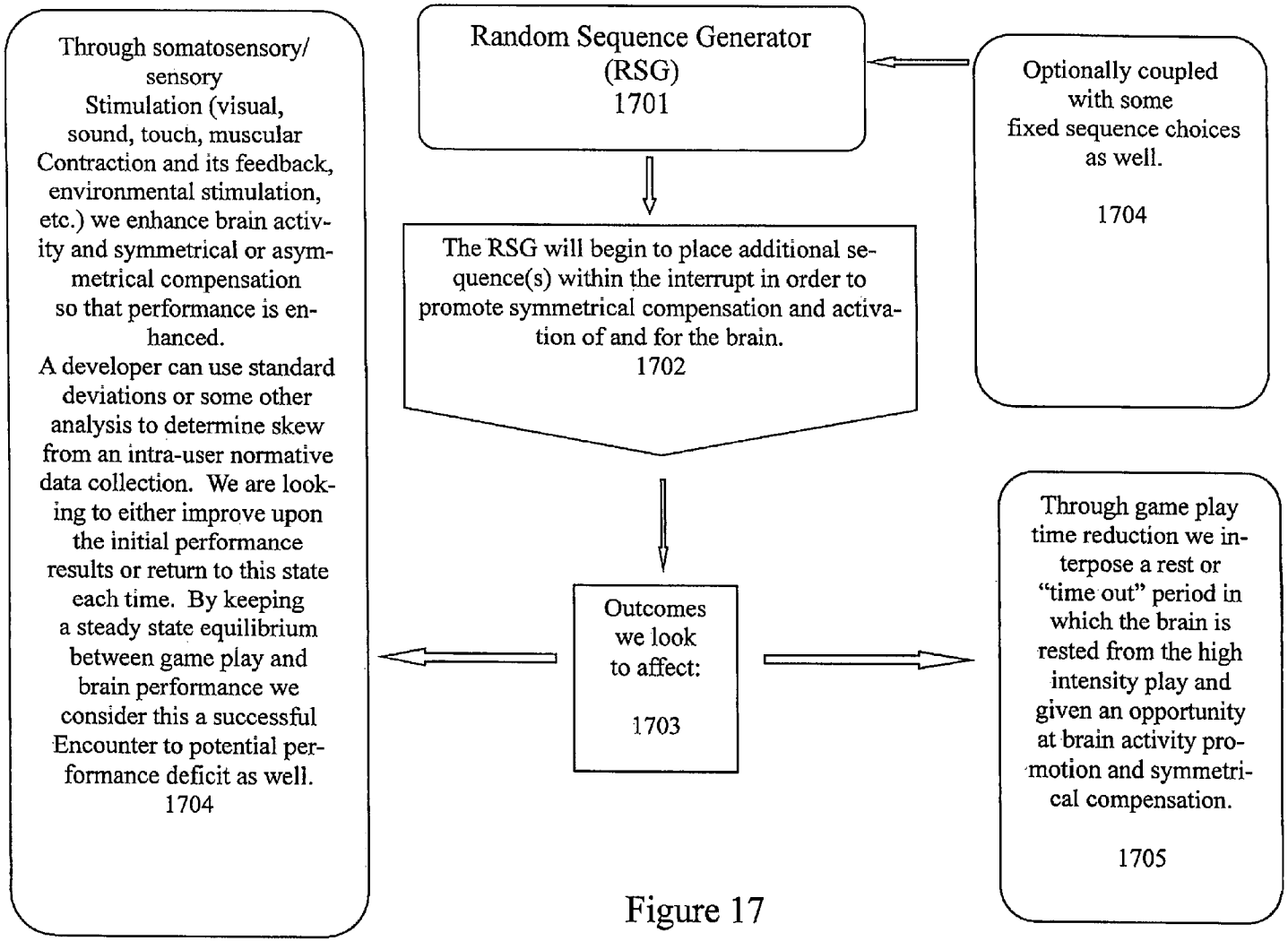

In FIG. 17, the random sequence generator 1701 begins to place additional kinds of sequences into the interrupts in order to better activate the brain as revealed in the test results. That is, the generator 1701 randomly imposes on the user at step 1702 different kinds of color, saccadic, movement, pursuit, or other kinds of parameters discussed herein and known to the artisan to promote brain symmetry. As certain of those random activations succeed in obtaining the desired result of enhancing performance through stimulation/rest to promote beneficial bilateral brain activations, the users' performance criteria will improve and the system will record for that user the stimulations that produced the desired effect, for future activations. Ideally, a steady state scenario between game play and activation can be achieved at step 1704 as one outcome from step 1703. Otherwise, a rest period from game play may be imposed at step 1705.

Fixed sequence choices can also be added at step 1704 (rather than or in addition to random selections) at step 1704 in accordance with known or strategic expectations from the performance criteria of the user.

Figure 18:
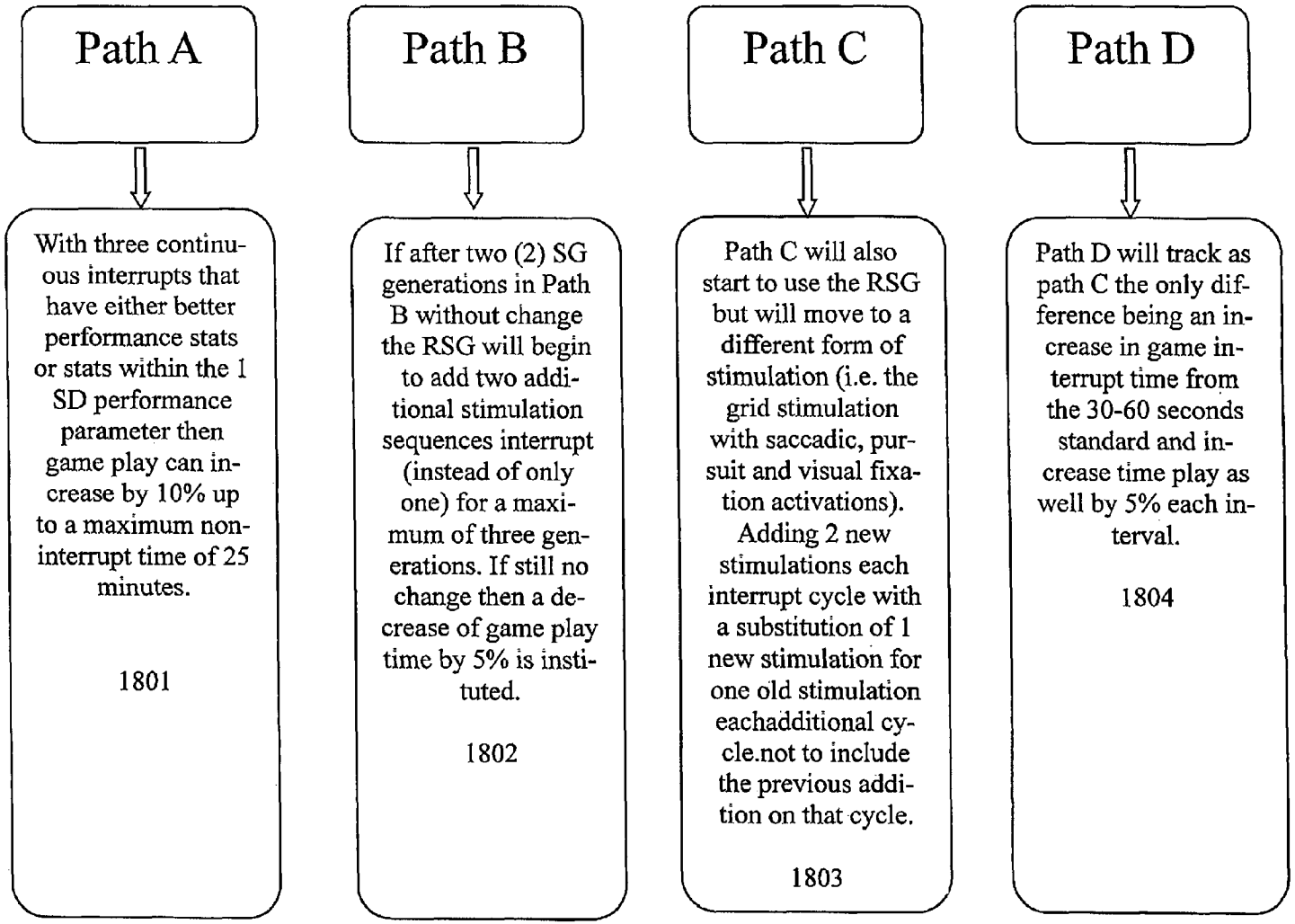

FIG. 18 illustrates further (or alternative) processes for the paths described. A user in Path A can achieved increased playing time between interruptions at step 1801 by demonstrating steady or improving performance. In Path B, game play can be reduced at step 1802 if no performance enhancement is realized within a certain number of iterations of testing. Additional stimulations can also be added to attempt to realize between performance from a user in Path B or C, in steps 1802 or 1803. Changing the kinds of stimulations used in step 1803 may also improve performance and allow a user to move from a Path C position to an improved (Path A or B) position. Similarly, a Path D user, at step 1804 will in general experience increased game interrupts for continued high standard deviation performance and will experience increased game play as performance improves.

Figure 19:
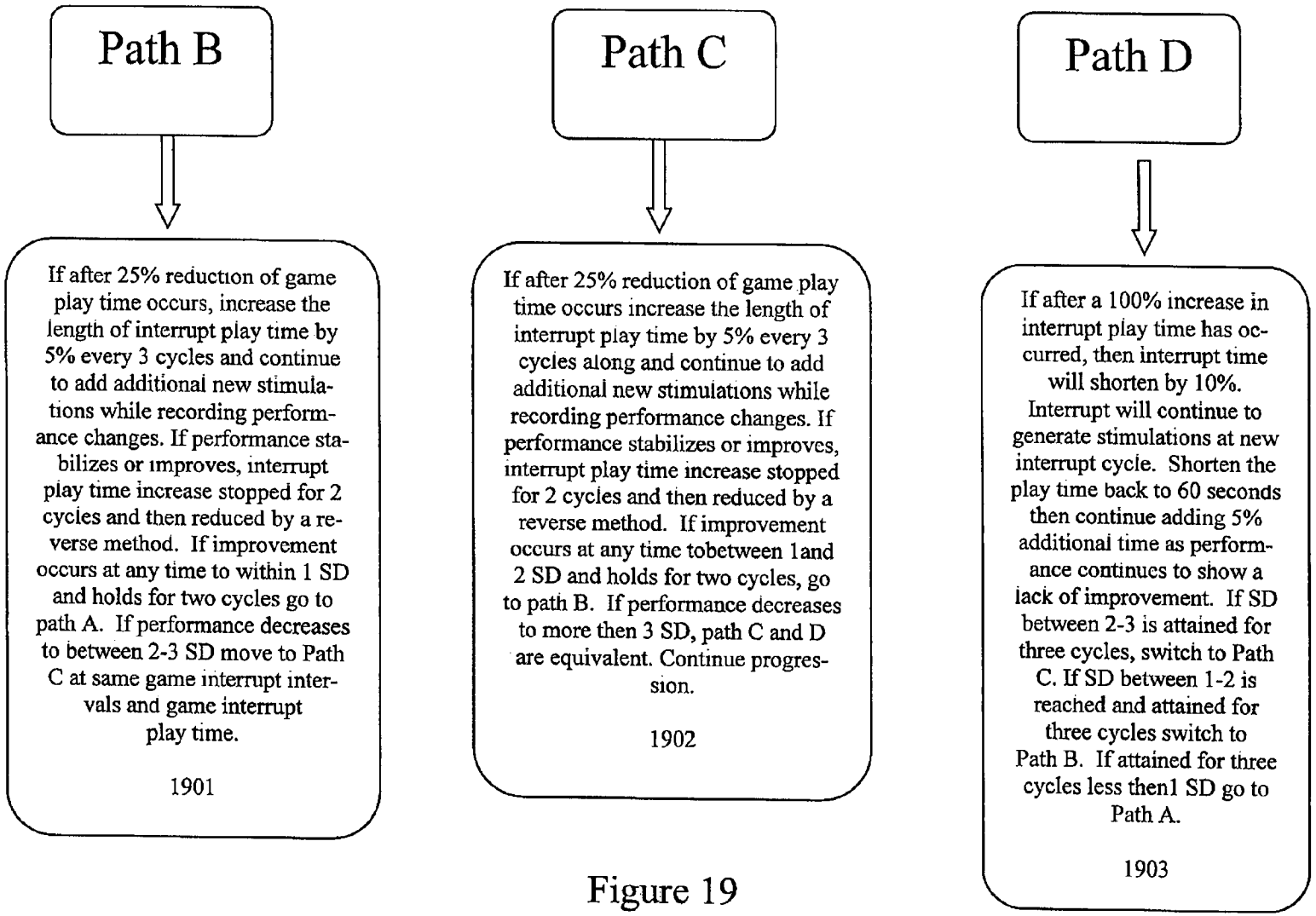

In FIG. 19, additional options for modifying game time, stimulations, length and number of stimulations, and other criteria are described in steps 1901, 1902, and 1903, for, respectively, Paths B, C, and D.

The invention may have application in various other environments including cell phone video displays and heads-up and/or dashboard automobile video displays in automobiles. In the automobile environment, one example embodiment can have lights (or other unconsciously perceived stimulation) on the left and right side of the driver (either in heads-up display, eyeglasses or on the dashboard) creating a pursuit, saccade, or peripheral visual occurrence that can be timed to tapping or pressure on sensors from both hands on the steering wheel. Windshields could be manufactured with imbedded grid systems that are linked to a present system which uses subliminal visual stimulations and activations linked to auditory stimulations or favorite musical artists' music that the system uses beat and rhythm to drive the interactive component of the system with steering wheel pressure gauges/buttons. With driving, especially highway driving, the user already has a fixed focus on the road (x many feet in front of the vehicle) which is ideal for the present system. In another iteration we could link light stimulations to all mirror systems which would be an additional proactive measure in having the driver use pursuit mechanisms to check his mirrors and activate the brain all at the same time. Performance enhancement from unconsciously perceived stimulation may be measured by, but not limited to, pulse rate, heart rate, pupil finders, eye closer, muscle tone etc.

The invention has been described in what is presently considered the most preferred embodiment, but other variations will be evident to those skilled in the art upon a full review of the present disclosure. Those variations and other equivalent structures and functions are considered to be included with the present invention even though not expressly described herein.

We claim:

1. A software routine stored on a non-transitory computer readable medium having thereon a video application to facilitate execution of a video presentation on a video screen, comprising:

an audiovisual application presenting to a user an interactive presentation on the video screen; and a brain activation routine injected into the interactive presentation to challenge and change dissymmetry of hemispheric brain activity at least partially caused by the interactive presentation by:

(1) producing a prominent object on the video screen tending to fixate the user's gaze;

(2) while the prominent object remains on the video screen, stimulating a predefined neuro-motor activity of a user and having a user provide bilateral user-input as a response to a visual event produced on the video screen, in which:

a. the visual event is at least one of (i) a moving visual object and (ii) a stationary visual object produced on the video screen in a different location from the prominent object to engage the user's peripheral vision; and b. the predefined neuro-motor activity is a bilateral user-input responsive to a predicted event on the video screen of the said at least one of (i) a moving visual object and (ii) a stationary visual object relative to another visual element on the video screen;

(3) recording and evaluating a time differential between the predicted event and the bilateral user-input responsive to that predicted event in step (2) and any perceived user performance change as an indicator of the dissymmetry of hemispheric brain activity; and (4) using the indicator from (3) to establish parameters for a next repetitive occurrence of (1), (2), and (3) based on changes in performance of the user during a previous one or more evaluations of (3) to thereby treat brain dissymmetry;

the parameters including at least one of:

a baseline;

a screen feature from which moving features split off to stimulate bilateral motor response;

routine injection timing;

routine duration; and different kinds of stimulus including color, saccadic events, movement, sound, pursuit or other activity to promote brain symmetry;

wherein the step of using the indicator to establish parameters include at least one of:

creating a new base line as parameters for future run directions;

generating new sequences to affect stimulation of bilateral brain activation based upon performance markers of previous results;

generating screen features to stimulate bilateral response and adjusting future injected routines based upon user input following the moving features;

resetting a future injected routine to challenge dissymmetry of hemispheric brain activity based upon bilateral user-input accuracy in performing stimulated neuro-motor activity;

adjusting content within the future injected routines based upon somatosensory feedback data;

establishing a reset criteria;

establishing random sequence changes in future injected routines;

adjust the ability level for future injected routines;

resetting subsequent interrupts of the audiovisual presentation for an injected routine; or generating a length of an uninterrupted audiovisual presentation prior to the next injected adjusted routine.

2. A software routine according to claim 1, wherein the visual event includes two moving objects on the video screen, one moving object moving from the prominent object and toward one contact point near one portion of the video screen and the other moving object moving from the same prominent object and toward a different contact point near an opposing portion of the video screen.

3. A software routine according to claim 2, wherein the prominent object appears in the center portion of the video screen and the two moving objects move from the prominent object respectively to the opposing portions of the video screen.

4. A software routine according to claim 2 wherein one of the moving objects changes its speed during its respective travels from the prominent object to the opposing portions of the video screen and wherein the one of the moving objects accelerates relative to the other moving object as the accelerating moving object nears its corresponding opposing portion of the video screen.

5. A software routine according to claim 1, wherein the visual event further coincides with an audio event.

6. A software routine according to claim 1, wherein:

the brain activation routine further includes:

stimulating the predefined neuro-motor activity of the user in response to a plurality of consecutive visual events produced on the video screen, in which:

a. the plurality of consecutive visual events include the moving visual object produced on the video screen intersecting a number of consecutive contact points on the video screen; and b. the predefined neuro-motor activity includes repetitive user-inputs responsive to predicted occurrences of the moving visual object with the consecutive contact points; and the time differential is recorded and evaluated for each predicted occurrence.

7. A method of improving brain function by encouraging bilateral brain activation during a routine electronics video activity on a video screen, comprising:

interrupting the routine electronics video activity, and then stimulating a predefined neuro-motor activity of a user in response to an injected visual event produced on the video screen, in which:

a. the visual event is at least one of (i) a moving visual object and (ii) a stationary visual object produced on the video screen, and b. the predefined neuro-motor activity is a predictive user-input response to an interaction on the video screen between the said at least one of (i) a moving visual object and (ii) a stationary visual object and another visual element;

recording a time characteristic associating a time occurrence of predictive user-input and a time occurrence of the interaction between the visual event and the other visual element indicating a degree of time coordination of the input received from the input device and the interaction and thereby any resulting imbalance between the predictive user-input and the input received, repeating the visual event, interaction, and, user-input, and recording steps a number of times, setting a time duration to elapse before a next interruption of the routine electronics video activity and establishing stimulation content for a next interruption, based on a mathematical analysis of a change in the recorded time characteristic over the repeated steps, disabling the interruption to again engage the routine electronics video activity for no more than the set time duration; and establishing parameters for subsequent bilateral brain activation including at least one of:

a baseline;

a screen feature from which moving features split off to stimulate bilateral motor response;

routine injection timing;

routine duration; and different kinds of stimulus including color, saccadic events, movement, sound pursuit or other activity to promote brain symmetry; and further including at least one of the following steps:

creating a new base line as parameters for future interruption directions;

generating new sequences to affect stimulation of bilateral brain activation based upon performance markers of previous results;

generating screen features to stimulate bilateral response and adjusting future injected events based upon user input following the moving features;

resetting a future injected events to challenge dissymmetry of hemispheric brain activity based upon bilateral user-input accuracy in performing stimulated neuro-motor activity;

adjusting content within the future injected events based upon somatosensory feedback data;

establishing a reset criteria;

establishing random sequence changes in future injected events;

adjust the ability level for future injected events;

resetting subsequent interrupts of the video activity for an injected routine; or generating a length of an uninterrupted video activity prior to the next injected adjusted event.

8. A method according to claim 7, wherein the video event further includes a combination of moving and stationary objects on a video screen and wherein at least some of the moving objects move simultaneously in different directions toward a periphery of the video screen, and further wherein the time occurrence of the interaction is a visual coincidence between a location of at least a portion of one of the moving objects on the video screen and a location of at least a portion of said other visual element on the video screen.

9. A method according to claim 7, wherein the electronics video activity includes a video game presentation.

10. A method according to claim 9, wherein the video presentation the visual sensory event is generally indistinguishable from the video game presentation.

11. A software routine promoting brain symmetry stored on a non-transitory computer readable medium having thereon an audio-video application to facilitate execution of an audio-video presentation on a video screen, and to periodically interrupt the audio-video presentation, comprising:

an audio-visual application presenting to a user an interactive audio-video presentation on the video screen; and a brain activation routine periodically injected into the interactive audio-video presentation to change dissymmetry of hemispheric brain activity at least partially caused by the interactive presentation by:

(1) producing a prominent object on the video screen tending to fixate the user's gaze;

(2) then, while having the prominent object remaining on the video screen, stimulating a predefined neuro-motor activity of a user in response to a visual event produced on the video screen, in which:

(a) the visual event is a visual object produced on the video screen in a different location from the prominent object to engage the user's peripheral vision; and (b) the predefined neuro-motor activity is a user-input responsive to a predicted event on the video screen correlated with the visual object relative to another visual element on the video screen;

(3) recording and evaluating the user's responses to step (2) relative-to-predicted responses correlated to the predicted event and any resulting change based upon user responses;

(4) using the evaluation of step (3) to establish when to again initiate subsequent interruptions of the interactive audio-video presentation and to establish parameters for the next brain activation routine to encourage bilateral brain activation;

changing the parameters for the next brain activation routine and determining when and how to subsequently interrupt the interactive audio-video presentation, the parameters including at least one of:

a baseline;

a screen feature from which moving features split off to stimulate bilateral motor response;

routine injection timing;

routine duration; and different kinds of stimulus including color, saccadic events movement, sound, pursuit or other activity to promote brain symmetry;

wherein the step of using the indicator to establish parameters include at least one of:

creating a new base line as parameters for future run directions;

generating new sequences to affect stimulation of bilateral brain activation based upon performance markers of previous results;

generating screen features to stimulate bilateral response and adjusting future injected routines based upon user input following the moving features;

resetting a future injected routine to challenge dissymmetry of hemispheric brain activity based upon bilateral user-input accuracy in performing stimulated neuro-motor activity;

adjusting content within the future injected routines based upon somatosensory feedback data;

establishing a reset criteria;

establishing random sequence changes in future injected routines;

adjust the ability level for future injected routines;

resetting subsequent interrupts of the audiovisual presentation for an injected routine; or generating a length of an uninterrupted audiovisual presentation prior to the next injected adjusted routine.

12. The software routine as in claim 11 wherein the brain activation routine injected into the interactive audio-video presentation during the interruption occurs as an integral part of the interactive audio-video presentation.

13. The software routine as in claim 11 wherein there is a seamless transition between the interactive audio-video presentation and the brain activation routine.

14. The software routine as in claim 11 wherein the visual event is at least one of (i) a moving visual object and (ii) a stationary visual object produced on the video screen.

15. The software routine as in claim 11 wherein the brain activation routine is embedded within the audio-video application.

* * * * *